US006600472B1

(12) United States Patent
Nakai et al.

(10) Patent No.: US 6,600,472 B1
(45) Date of Patent: Jul. 29, 2003

(54) LIQUID CRYSTAL DISPLAY DEVICE

(75) Inventors: Yutaka Nakai, Tokyo (JP); Masahiko Akiyama, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/267,790

(22) Filed: Mar. 15, 1999

(30) Foreign Application Priority Data

Mar. 19, 1998 (JP) ..... 10-071060

(51) Int. Cl.[7] ..... G09G 3/36

(52) U.S. Cl. ..... 345/91; 345/90; 345/92; 345/205; 345/206

(58) Field of Search ..... 345/90, 91, 92, 345/205, 206, 94, 89, 690, 694

(56) References Cited

U.S. PATENT DOCUMENTS

| | | | | | |
|---|---|---|---|---|---|
| 3,259,794 | A | * | 7/1966 | Krawitz | 315/151 |
| 3,647,958 | A | * | 3/1972 | Sobel | 315/169.1 |
| 4,432,610 | A | * | 2/1984 | Kobayashi et al. | 349/42 |
| 5,033,823 | A | * | 7/1991 | Shannon | 349/143 |
| 5,126,865 | A | * | 6/1992 | Sarma | 349/85 |
| 5,296,870 | A | * | 3/1994 | Nicholas | 345/694 |
| 5,471,225 | A | * | 11/1995 | Parks | 345/98 |
| 5,576,728 | A | * | 11/1996 | Maeda | 345/91 |
| 5,581,273 | A | * | 12/1996 | Yoneda et al. | 345/90 |
| 5,627,557 | A | * | 5/1997 | Yamaguchi et al. | 345/90 |
| 5,666,130 | A | * | 9/1997 | Williams et al. | 345/90 |
| 5,923,311 | A | * | 7/1999 | Edwards | 345/92 |
| 6,057,819 | A | * | 5/2000 | Sone et al. | 345/96 |
| 6,072,454 | A | * | 6/2000 | Nakai et al. | 345/97 |
| 6,163,348 | A | * | 12/2000 | Izumi et al. | 348/751 |

FOREIGN PATENT DOCUMENTS

| | | | | |
|---|---|---|---|---|
| JP | 2-272521 | | 11/1990 | |
| JP | 404340932 | * | 11/1992 | |
| JP | 404340932 A | * | 11/1992 | 345/91 |
| JP | 5-119298 | | 5/1993 | |

* cited by examiner

*Primary Examiner*—Richard Hjerpe
*Assistant Examiner*—Kevin M. Nguyen
(74) *Attorney, Agent, or Firm*—Oblon, Spivak, McClelland, Maier & Neustadt, P.C.

(57) ABSTRACT

In this invention, as a basic structure, an impedance element is connected in series to a liquid crystal layer (liquid crystal capacitance) of each pixel. The impedance of the impedance element is varied in accordance with a display signal. The resistance values of variable resistance elements are varied in accordance with a display signal being held by a display signal holding means that is provided in each pixel, whereby the impedance of the impedance element varies in accordance with the resistance states of the variable resistance elements. If an AC voltage is applied across the basic structure, an AC voltage produced by voltage division in accordance with the impedance of the impedance element is applied to the liquid crystal layer. Therefore, the AC voltage applied to the liquid crystal layer and hence the gradation level of the liquid crystal layer can be controlled by adjusting the impedance of the impedance element in accordance with a display signal. A display signal is not input to the liquid crystal layer directly and consumed there. Instead, an AC voltage produced by dividing, by the impedance element and the liquid crystal layer, an AC voltage corresponding to a display signal that is temporarily held by the holding means such as a capacitor is applied to the liquid crystal layer. Therefore, the power consumption can be reduced.

17 Claims, 29 Drawing Sheets

| Ci／Cp ,Cp=CLs+Cs | — |
|---|---|
| C1／Cp | 0.047 |
| C2／Cp | 0.081 |
| C3／Cp | 0.176 |
| C4／Cp | 0.370 |

Fig.20

| j | $\gamma j$ |
|---|---|
| 1 | 0.0083 |
| 2 | 0.0139 |
| 3 | 0.0283 |
| 4 | 0.0582 |
| 5 | 0.1236 |
| 6 | 0.2469 |
| 7 | 0.4925 |
| 8 | 0.9802 |

Fig.27

| j | $\gamma j$ |
|---|---|
| 1 | 0.0129 |
| 2 | 0.0217 |
| 3 | 0.0444 |
| 4 | 0.0929 |
| 5 | 0.1806 |
| 6 | 0.3736 |

Fig.28

LIQUID CRYSTAL DISPLAY DEVICE

BACKGROUND OF THE INVENTION

1. Field of the Invention

The present invention relates to a liquid crystal display device capable of halftone imaging display.

2. Description of the Related Art

FIG. 29 shows the configuration of a conventional liquid crystal display device. As shown in FIG. 29, a signal line 94 and a gate line 93 are provided and a thin-film transistor (TFT) 91 is provided in the vicinity of their crossing point. When rendered in a selected state (on-state), the thin-film transistor 91 supplies charge to an auxiliary capacitor (storage capacitor) 95 and a liquid crystal layer (liquid crystal capacitance) 92 via a pixel electrode 96. One pixel is constituted of the pixel electrode 96, a common electrode 98 confronting it, and the liquid crystal layer 92.

As is well known, to prevent deterioration of the liquid crystal layer 92, it is necessary to apply an AC voltage to the liquid crystal layer 92.

In the above type of liquid crystal display device, since it is necessary to apply an AC voltage even during a period when there are no variations in display, the potential of the pixel electrode 96 is rewritten every time the pixel is selected, that is, once per frame period.

When an AC voltage, is applied to the capacitors including the liquid crystal layer (liquid crystal capacitance) 92 and the auxiliary capacitor (storage capacitor) 95, the power consumption P is given by $P=f\times V^2\times C$ where f, V, and C represent the frequency, the voltage, and the total capacitance, respectively. Therefore, the power consumption increases as any of the frequency, voltage, and total capacitance increases.

In the AC driving of the liquid crystal display device, the driving frequency for each pixel is equal to the frame frequency, the driving frequency for each signal line is equal to the product of the frame frequency and the number of scanning lines, and the driving frequency of a signal line driver circuit (driver IC) 97 is equal to the product of the total number of pixels of the display screen and the frame frequency.

At present, where the liquid crystal display device is a color VGA (640×3 (RGB)×480 pixels) device having a 10.4-in. diagonal size, the power consumption of the signal line driver circuit 97 is about 1 W. Therefore, in the case of an A4-size, high-resolution (corresponding to 150 dpi) liquid crystal display device, the number of pixels amounts to 1,600×1,200, which is 6.25 times that of the VGA device, and hence the power consumption is as high as about 2–3 W or more.

Using a liquid crystal display device having such high power consumption as the display device of a portable information apparatus causes a problem that the usable time, which is limited by the battery performance, is shortened.

One method of solving this problem is use of a surface stabilized ferroelectric liquid crystal (SSFLC). In this case, the liquid crystal is given memorizing ability and hence the voltage supply can be stopped until a change occurs in display, which enables reduction in power consumption. However, because of the bistable nature, the liquid crystal display device basically performs binary imaging display. In this type of liquid crystal display device, it is difficult to perform halftone display and its power of expression is much lower than in a display mode capable of halftone imaging display.

Further, liquid crystals having memorizing ability are limited in display quality (contract, reflectance, etc.). For example, the display mode of the SSFLC necessarily requires polarizing plates, resulting in a small reflectance value of about 30%, which means a dark screen.

SUMMARY OF THE INVENTION

The present invention has been made to solve the above problems in the art, and an object of the invention is therefore to provide a liquid crystal display device using a novel driving method which can reduce the power consumption relating to the driving and can easily provide halftone and hence perform superior halftone imaging display.

According to a first aspect of the invention, there is provided a liquid crystal display device comprising a liquid crystal layer held between a first electrode and a second electrode; means for applying an AC voltage to the first electrode or the second electrode; means for supplying a display signal; means f or selecting the display signal; means for holding the selected display signal; and an impedance element connected in series to the first electrode, an impedance of the impedance element being varied in accordance with the display signal being held.

Alternatively, there is provided a liquid crystal display device comprising a liquid crystal layer held between first electrodes and a second electrode; holding means such as a capacitor provided for each of the first electrodes, for holding a display signal; an a an impedance element connected in series to each of the first electrode and including a variable resistance element whose impedance is varied in accordance with the display signal.

As a further alternative, there is provided a liquid crystal display device comprising a first substrate on which first electrodes are arranged in matrix form; a second substrate on which a second electrode is provided; a liquid crystal layer held between the first electrodes and the second electrode; means for applying an AC voltage to each of the first electrodes or the second electrode; means for supplying a display signal; means provided for each of the first electrodes, for selecting and holding the display signal; and an impedance element connected in series to each of the first electrodes, an impedance of the impedance element being varied in accordance with the display signal being held.

For example, the first electrodes a re pixel electrodes and the second electrode is an opposed electrode (common electrode) A pixel is constituted of each of the first electrodes, the second electrode, and the liquid crystal layer held in between.

An IPS (in-plane switching) mode liquid crystal display device may be constructed by disposing the first electrodes and the second electrode on the same substrate.

The pixel electrodes may be arranged in matrix form on a substrate that is made of glass, quartz, or the like and at least the surface of which is insulating. By arranging pixels two-dimensionally in this manner, incident light on the liquid crystal layer is modulated two-dimensionally to perform display.

Where the first electrodes are pixel electrodes, covering driving elements with the pixel electrodes is preferable for the purpose of increasing the aperture ratio. Where the pixel electrodes are reflection electrodes, the invention can be applied to a reflection-type liquid crystal display device. In this case, since the selecting means and the holding means can be formed under the reflection electrode, the degree of design freedom increases even if the driving element is increased in size.

The display signal is a signal for controlling the states of the pixels, that is, the states of the liquid crystal layer held between the first electrodes and the second electrode.

For example, the means for supplying such a display signal is signal supply lines. A plurality of display signal supplying means may be provided rather than a single one.

The means for selecting a display signal is means for performing, on apixel-by-pixelbasis, selection/sampling onthe display signal that is supplied in the above manner. For example, a nonlinear switching element such as a thin-film transistor whose source or drain is connected to a signal line may be used as the display signal selecting means. By controlling the gate electrode of the thin-film transistor by a scanning signal, a display signal can be captured independently for each of arbitrary pixels.

Where the display signal is supplied to the pixels as digital data, a sampling circuit may be constructed by combining, for example, logic gates, data latches, a shift register, etc.

For example, the impedance element may be a parallel connection of a plurality of series connections of a variable resistance element and a capacitance element.

The plurality of capacitance values may be so set that their combinations provide gradation voltages that vary smoothly.

It is preferable that the capacitance of the impedance element be so set as to be smaller than a capacitance formed by each of the first electrode, the second electrode, and the liquid crystal layer held in between, that is, a liquid crystal capacitance.

A capacitive load as viewed from the display signal supply side when a display signal is held that includes the display signal holding means for each pixel and the impedance element may be set smaller than the liquid crystal capacitance.

The variable resistance elements may be given different impedance values in accordance with a display signal being held by the display signal holding means that is provided for each pixel.

For example, the variable resistance element may be a three-terminal element such as a thin-film transistor. Not only is the variable resistance element used as a switching element for an on/off control but also its middle resistance value may be used.

The plurality of capacitance values may be so set that combinations of selected ones of the capacitance values correspond to smoothly varied gradation levels.

According to the first aspect of the invention, since the impedance element that is connected in series to the liquid crystal capacitance is a parallel connection of a plurality of series connections of a variable resistance element and a capacitance element, a voltage that is applied to the liquid crystal layer constituting each pixel can be controlled digitally by controlling the states of the variable resistance elements. Therefore, it becomes possible to display halftone in a stable manner.

By making the impedance values of the respective variable resistance elements different from each other in accordance with a display signal, the liquid crystal application voltage can be varied gently in accordance with a display signal stored in each pixel. This enables a correct halftone control even in the case of analog-like halftone display.

Further, according to the first aspect of the invention, a display signal is written from a signal line to the holding means such as an auxiliary capacitor rather than charge is directly written from the signal line to the liquid crystal layer as in the conventional case. Therefore, if the auxiliary capacitance is set smaller than the liquid crystal capacitance, the load capacitance of the signal line of each pixel is reduced but also a display signal can be written quickly at the time of pixel selection, which shorten the pixel selection time. Therefore, the first aspect of the invention makes it possible to increase the screen size and the resolution of a liquid crystal display device.

According to a second aspect of the invention, there is provided a liquid crystal display device comprising a liquid crystal layer held between a first electrode and a second electrode; means for supplying a display signal; means for selecting the display signal; a variable capacitance element connected in series to the first electrode, a capacitance of the variable capacitance element being varied in accordance with the selected display signal; first applying means for applying a first AC voltage; second applying means for applying a second AC voltage that is different in amplitude from the first AC voltage; and switching means for applying the first AC voltage or the second AC voltage to the first electrode or the second electrode via the variable capacitance element in accordance with the selected display signal.

The variable capacitance element may comprise a parallel connection of a plurality of series connections of a switching element and a capacitor, and the capacitance of the variable capacitance element may be varied by turning on or off the switching elements in accordance with the selected display signal.

The switching means may be a decoder that on/off-controls the switching elements in accordance with the display signal.

A first gradation range of the liquid crystal layer that is displayed through application of the first AC voltage may be made continuous with a second gradation range of the liquid crystal layer that is displayed through application of the second AC voltage.

According to a third aspect of the invention, there is provided a liquid crystal display device comprising a first liquid crystal layer held between a first electrode and a second electrode; a second liquid crystal layer held between the second electrode and a third electrode and laid on the first liquid crystal layer; a third liquid crystal layer held between the third electrode and an opposed electrode and laid on the second liquid crystal layer; first applying means for applying a first AC voltage; second applying means for applying a second AC voltage; third applying means for applying a third AC voltage; a first variable capacitance element interposed between the first applying means and the first electrode, a capacitance of the first variable capacitance element being varied in accordance with a first display signal; a second variable capacitance element interposed between the second applying means and the second electrode, a capacitance of the second variable capacitance element being varied in accordance with a second display signal; and a third variable capacitance element interposed between the third applying means and the third electrode, a capacitance of the third variable capacitance element being varied in accordance with a third display signal, wherein voltages produced by dividing the first, second, and third AC voltages by the first, second, and third variable capacitance elements and the first, second, and third liquid crystal layers are applied to the first, second, and third electrodes, respectively.

In the above liquid crystal display device, the first, second, and third AC voltages may have the same frequency and phases of AC voltages that are applied to a plurality of pixel electrodes that constitute a unit pixel may be equalized for the unit pixel.

Each of the first, second, and third variable capacitance elements may comprise a parallel connection of a plurality of series connections of a switching element and a capacitor, and the capacitances of the first, second, and third variable capacitance elements may be varied by turning on or off the switching elements in accordance with the first, second, and third display signals, respectively.

A first gradation range of the first, second, or third liquid crystal layer that is displayed through application of the first AC voltage may be made continuous with a second gradation range of the first, second, or third liquid crystal layer that is displayed through application of the second AC voltage.

The first and second liquid crystal layers may be made of guest-host liquid crystals containing dyes of different colors and laid one on anther to constitute a unit pixel.

Alternatively, there is provided a liquid crystal display device in which a plurality of liquid crystal layers are laid one on another and intermediate electrodes are provided, comprising a variable capacitance forming sections each including a plurality of capacitors and switches for selection of the capacitances; liquid crystals corrected to the respective variable capacitance forming sections (and driven by respective pixel electrodes); and a pixel circuit for applying AC voltages and controlling the AC voltages to be applied to the respective liquid crystals through capacitive voltage division, wherein the AC voltages have the same frequency and phases of AC voltages that are applied to a plurality of pixel electrodes that constitute a unit pixel are equalized for the unit pixel.

According to the second and third aspects of the invention, in a liquid crystal display device having a plurality of pixels, a variable capacitance element provided in each pixel and constituted of a plurality of capacitors and switches for selection of those capacitors, a liquid crystal connected to the variable capacitance element (and driven by a pixel electrode) , and a pixel circuit for applying an AC voltage and controlling an AC voltage to be applied to the pixel through capacitive voltage division, a circuit is further provided that selects among a plurality of AC voltages having different amplitudes and applies a selected AC voltage to the variable capacitance forming section.

For example, the variable capacitance element may be a parallel connection of a plurality of series connections of a capacitance element and a switch. A capacitance corresponding to a display signal can be formed by controlling, in accordance with the display signal, the number of switches to be turned on.

Since an AC voltage applied by the applying means is divided by the liquid crystal capacitance of the pixel and the capacitance of the variable capacitance element that varies in accordance with a display signal, an AC signal that is controlled in accordance with the display signal is applied to the liquid crystal layer.

The number of combinations of capacitors that constitute the variable capacitance element may be set larger than the desired number of display gradation levels.

An auxiliary capacitor may be so provided as to be connected in parallel to the liquid crystal capacitance in an AC-like manner.

The first AC voltage and the second AC voltage may be different amplitudes. AC voltages having different phases depending on the pixel may be applied. However, in a case where a plurality of liquid crystal layers are laid one on another and a unit pixel is constituted of a plurality of laminated pixels as in the case of a three-layer GH liquid crystal display device, for example, it is necessary that the first and secondAC voltages have the same phase difference within the unit pixel. For example, both of the frequencies and the phases of the first and second AC voltages may be equalized.

The switching means is to selectively apply the first or second AC voltage to the first or second electrode in accordance with a display signal, and may be made of switching elements such as thin-film transistors.

According to the liquid crystal display device, by employing the above configurations, the relationship between the gradation level of a displayed image and the voltage that is actually applied to the liquid crystal layer constituting each pixel can be corrected in consideration of the electro-optical response characteristic (transmittance/reflectance or the like) of the liquid crystal layer and the luminous efficiency, whereby superior halftone imaging display can be realized.

BRIEF DESCRIPTION OF THE DRAWINGS

FIG. 20 is a table showing capacitance values of capacitors of a variable capacitance element in the liquid crystal display device according to the fifth embodiment;

FIG. 27 is a table showing capacitance values used in the liquid crystal display device according to the sixth embodiment;

FIG. 28 is another table of capacitance values used in the liquid crystal display device according to the sixth embodiment.

DETAILED DESCRIPTION OF THE PREFERRED EMBODIMENTS

The present invention will be hereinafter described in detail by using illustrated embodiments.

Embodiment 1

Figure 1:
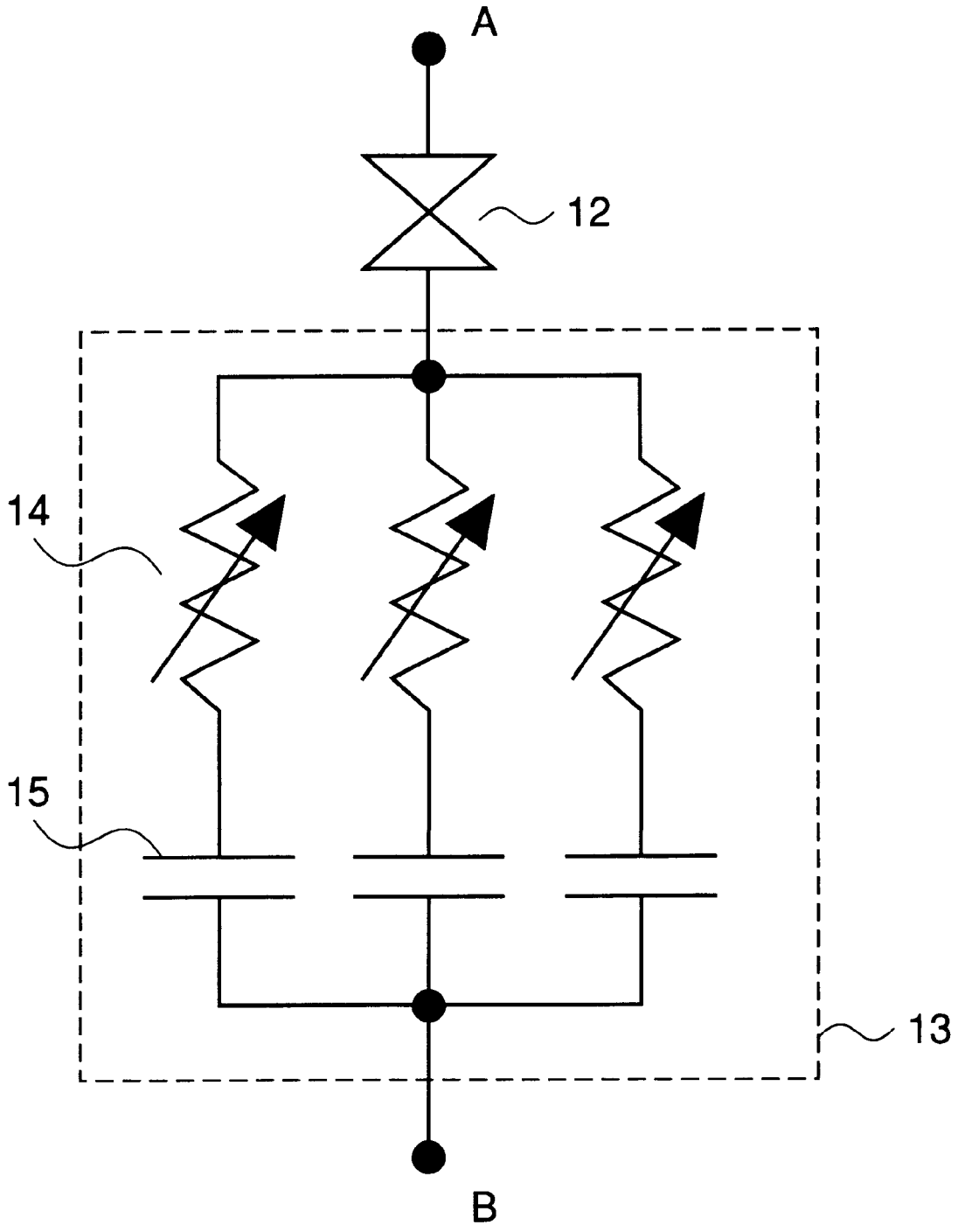
FIG. 1 shows the configuration of a unit pixel of a liquid crystal display device according to a first embodiment of the present invention.

FIG. 1 shows the configuration of a unit pixel of a liquid crystal display device according to a first embodiment of the invention.

An impedance element 13 is connected in series to a liquid crystal layer (liquid crystal capacitance) 12 of each pixel. The impedance element 13 is configured in such a manner that series connections of a variable resistance element 14 whose impedance value is varied in accordance with a display signal and a capacitor 15 for voltage division are connected together in parallel. Although in this example three sets of a variable resistance element and a capacitor are connected together in parallel, four or more sets may be connected together.

The resistance value of each variable resistance element 14 is varied in accordance with a display signal being held by a display signal holding means (e.g., a signal holding capacitor) that is provided in each pixel. The resistance value may be varied between a high-resistance state and a low-resistance state or may take intermediate resistance values. The impedance of the impedance element 13 varies in accordance with the resistance states of the variable resistance elements 14.

When an AC voltage is applied between electrodes A and B, a divided AC voltage produced in accordance with the impedance value of the impedance element 13 is applied to the liquid crystal layer 12. Therefore, the amplitude of an AC signal applied to the liquid crystal layer 12 can be controlled by adjusting the impedance of the impedance element 13 in accordance with a display signal.

An AC voltage is applied to prevent deterioration of the liquid crystal layer 12. If the frequency of the AC voltage is as low as 20 Hz, even slight asymmetry in the AC voltage is recognized as a flicker. Therefore, it is desirable that the AC voltage have a frequency of 30 Hz or more. Where the response speed of the liquid crystal is high, it is even preferable that the AC voltage have a frequency of 70 Hz or more. In contrast, in the invention, the asymmetry (the integrated value of negative portions of an AC voltage becomes larger than that of positive portions) of an application voltage to the liquid crystal can be made smaller than in the case of the conventional pixel configuration shown in FIG. 29. Therefore, if the asymmetry of the application voltage is extremely small, the frequency of the application voltage can be reduced to 30 Hz or less and the power consumption can be reduced accordingly.

Figure 2:
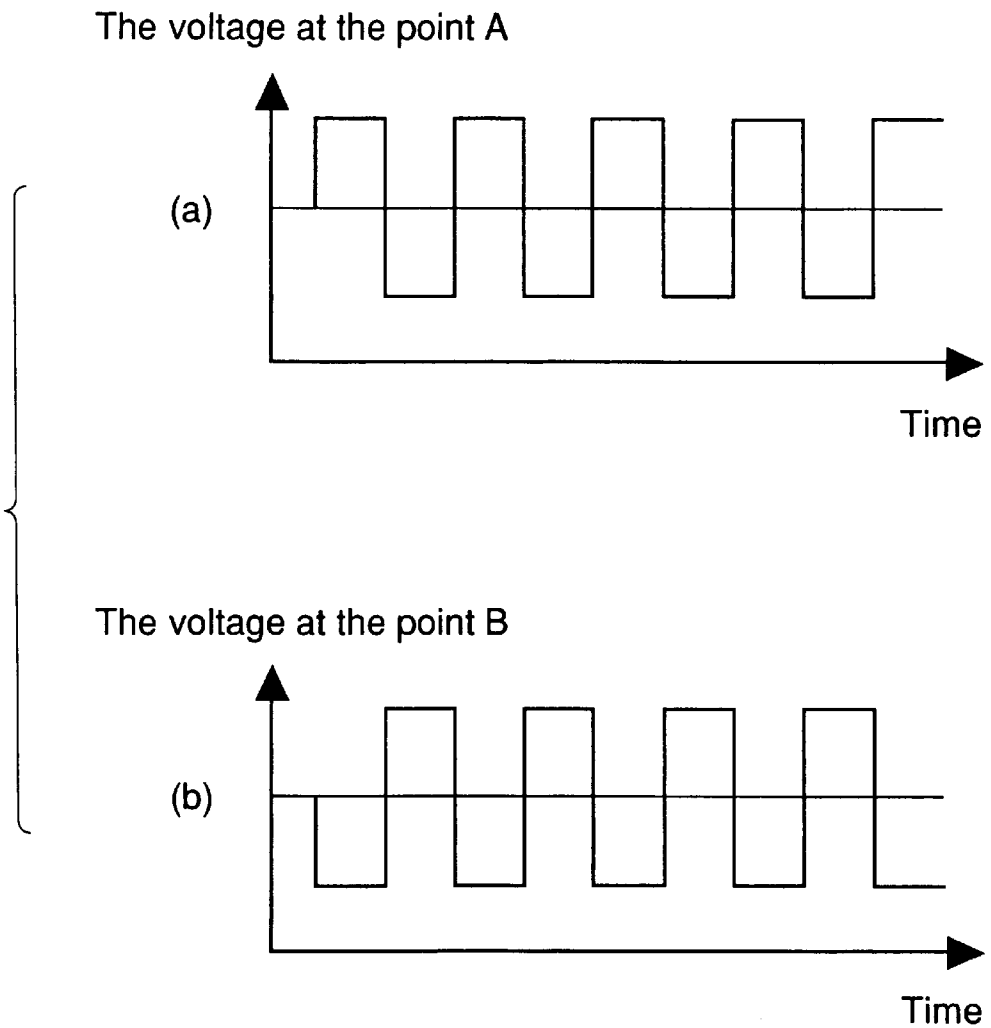
FIGS. 2(*a*) and 2(*b*) show an AC voltage that is applied between electrodes A and B.

FIGS. 2(*a*) and 2(*b*) show an AC voltage that is applied between the electrodes A and B. For example, the electrode A is a pixel electrode and the electrode B is an opposed electrode.

As shown in FIGS. 2(*a*) and 2(*b*), voltages opposite in polarity may be applied to the electrodes A and B. This makes it possible to decrease the amplitudes of voltages to be applied to the electrodes A and B, and hence can reduce the load of the driver circuit of the liquid crystal display device.

At least one of the parallel-connected sets may not include the capacitor 15. In this case, when the resistance values of the variable resistance elements 14 are set low, the voltage drop of the entire impedance element 13 can be made almost zero. Therefore, an AC voltage applied between the electrodes A and B can effectively be divided to produce an AC voltage to be applied to the liquid crystal layer 12.

Figure 3:
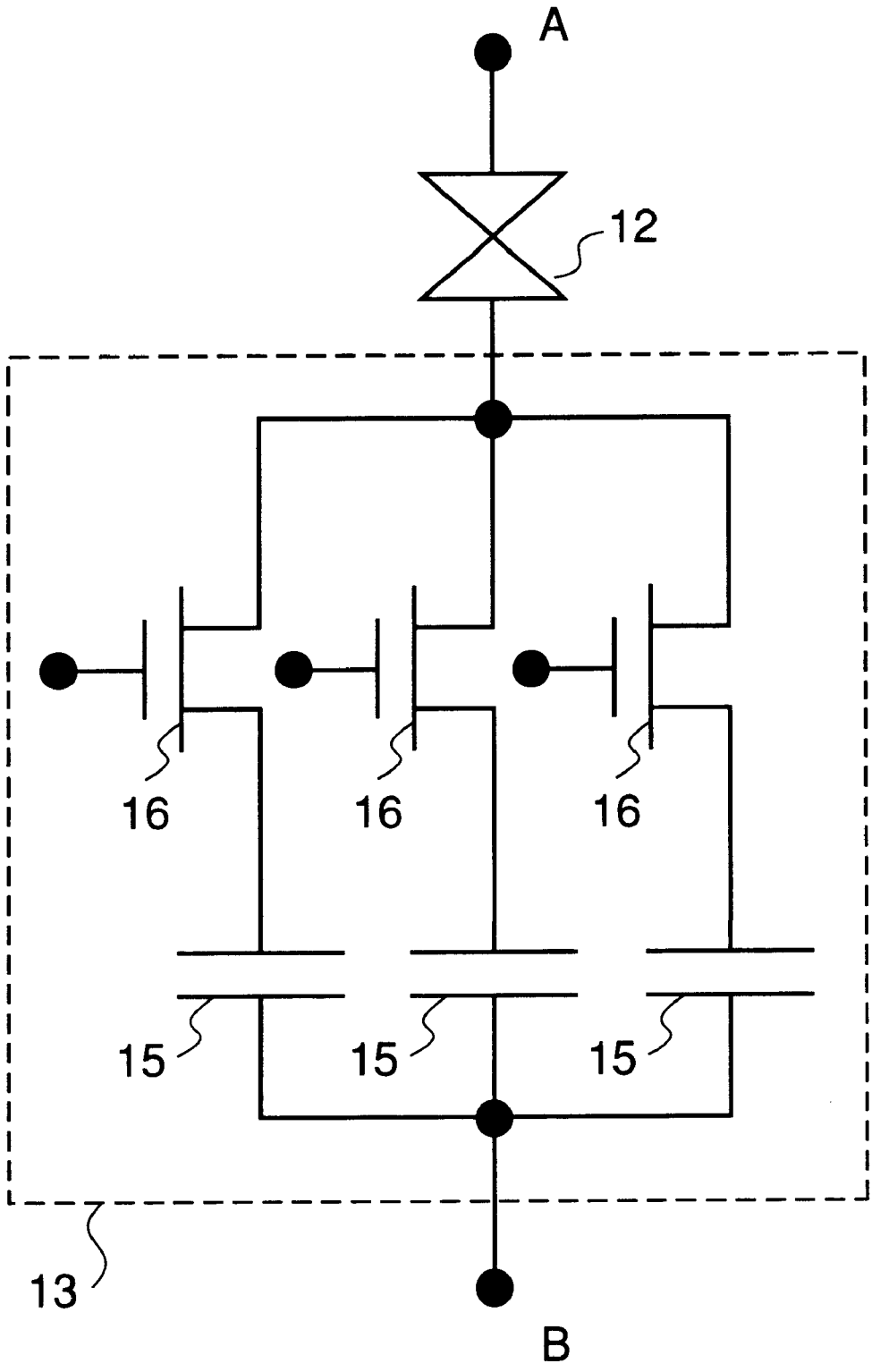
FIG. 3 shows the configuration of another example of a unit pixel of a liquid crystal display device according to the first embodiment.

FIG. 3 shows the configuration of another example of a unit pixel of a liquid crystal display device according to this embodiment. Transistors 16 are used instead of the variable resistance elements 14.

In this example, thin-film transistors are used that can be formed by the same manufacturing process as an active matrix liquid crystal display device. However, transistors other than thin-film transistors may also be used.

In the configuration of FIG. 3, the impedance value of the impedance element 13 varies in accordance with gate voltages of the respective thin-film transistors 16. In this example, it is assumed that the thin-film transistors 16 have n-type characteristics.

Figure 4:
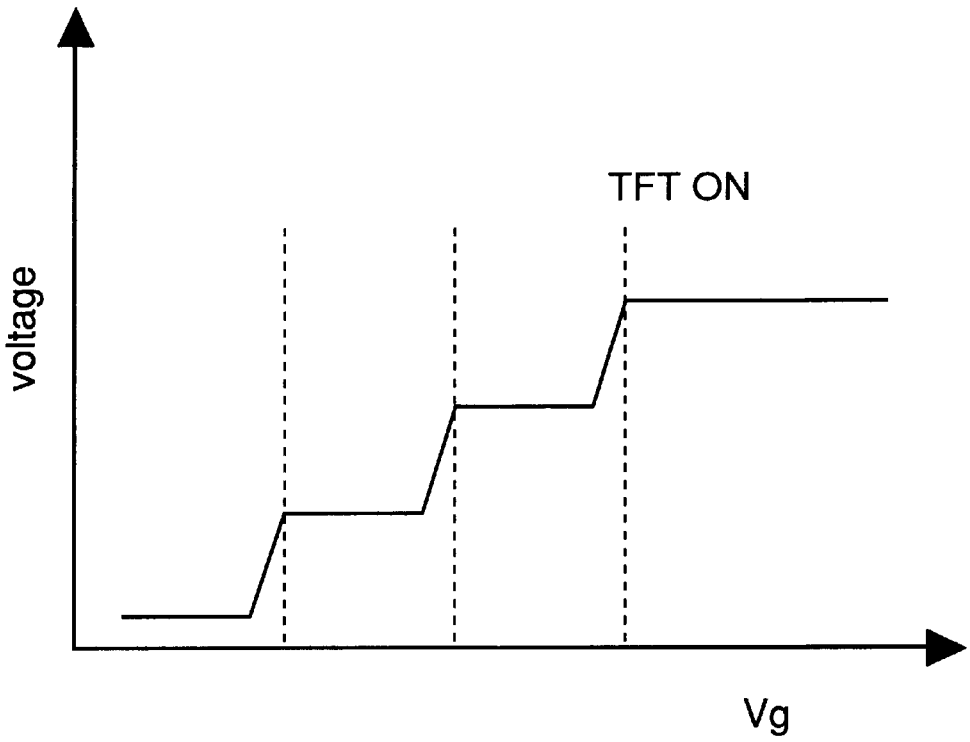
FIG. 4 is a graph showing a relationship between the gate voltage of each thin-film transistor of an impedance element and the voltage applied to a liquid crystal layer.

FIG. 4 is a graph showing a relationship between the gate voltage (V g) of the thin-film transistors 16 of the impedance element 13 and the voltage applied to the liquid crystal layer 12. The three voltage dividing capacitors 15 have approximately the same capacitance values. As the gate voltage is increased, the three thin-film transistors 16 are turned on sequentially and the liquid crystal application voltage varies so as to assume a step-like form of four levels shown in FIG. 4. Therefore, the pixel enables digital, four-halftone imaging display.

Conventional liquid crystal display devices have a problem that the accuracy of halftone display is low, because even if digital processing is performed in peripheral circuits such as a signal line driver circuit, analog processing is performed to finally apply an analog display signal to the liquid crystal layer. In contrast, in the liquid crystal display device of FIG. 3, a halftone image can be displayed with high accuracy if digital processing is performed at each pixel. Further, even if a display signal for each pixel is varied for some reason, a halftone image can still be displayed in a stable manner.

It is not always necessary that all the three voltage dividing capacitors 15 have the same capacitance value. Further, since in general the liquid crystal has a nonlinear optical characteristic with respect to the application voltage, the capacitance values of the voltage dividing capacitors 15 may be determined based on a result of a calculation of halftone level voltages in consideration of the final optical characteristic of the liquid crystal layer 12.

Figure 5:
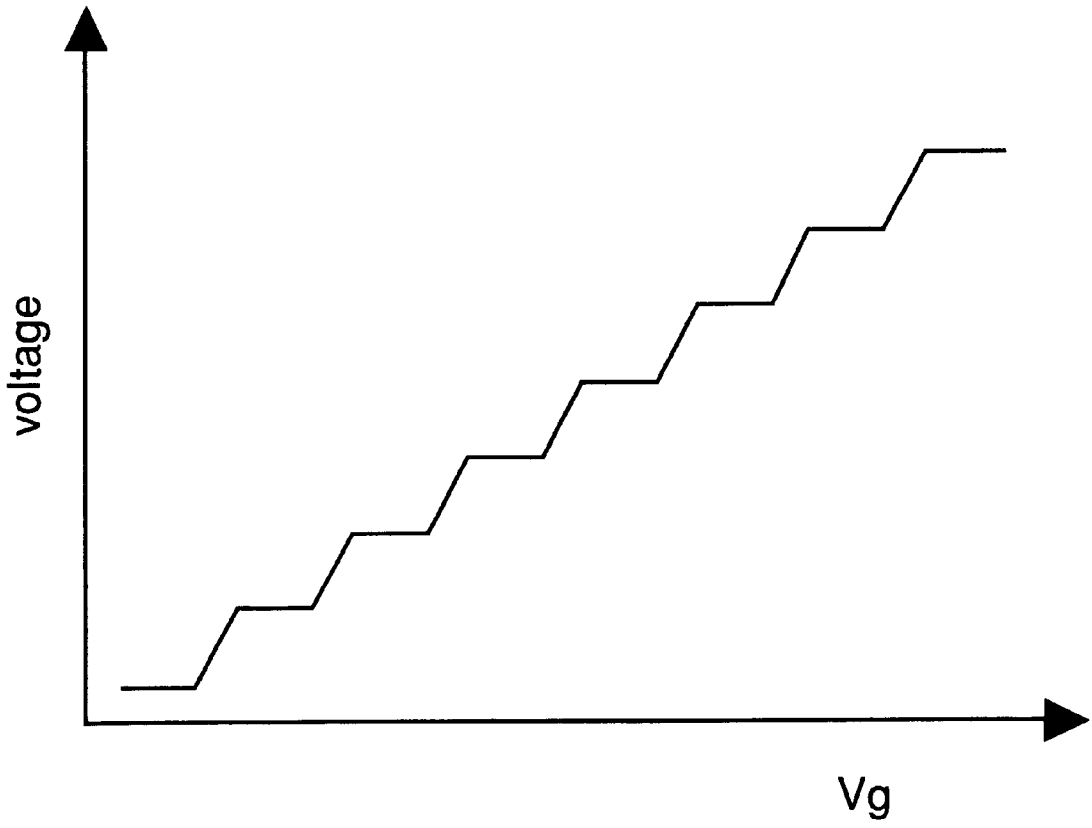
FIG. 5 is a graph showing another relationship between the gate voltage of each thin-film transistor of the impedance element and the voltage applied to the liquid crystal layer.

FIG. 5 is a graph showing another relationship between the gate voltage (V g) of the thin-film transistors 16 of the impedance element 13 and the voltage applied to the liquid crystal layer 12. This example employs a digital control method that is different from the above one.

In this example, the pixel configuration of FIG. 3 is employed and the capacitance values of the voltage dividing capacitors 15 are so set that voltages applied to the liquid crystal layer 12 when the respective thin-film transistors 16 of the impedance element 13 are turned on have a ratio 1:2:4.

Therefore, image data of 3 bits, that is, 8 gradation levels, can be displayed according to the on/off combination of the gates of the three thin-film transistors 16. It is not always necessary to determine the capacitance values of the three voltage dividing capacitors 15 based on voltages to be applied to the liquid crystal layer 12. Since the liquid crystal has a nonlinear optical characteristic with respect to the application voltage, the capacitance values of the voltage dividing capacitors 15 may be determined in consideration of the final optical characteristic of the liquid crystal layer 12.

Figure 6:
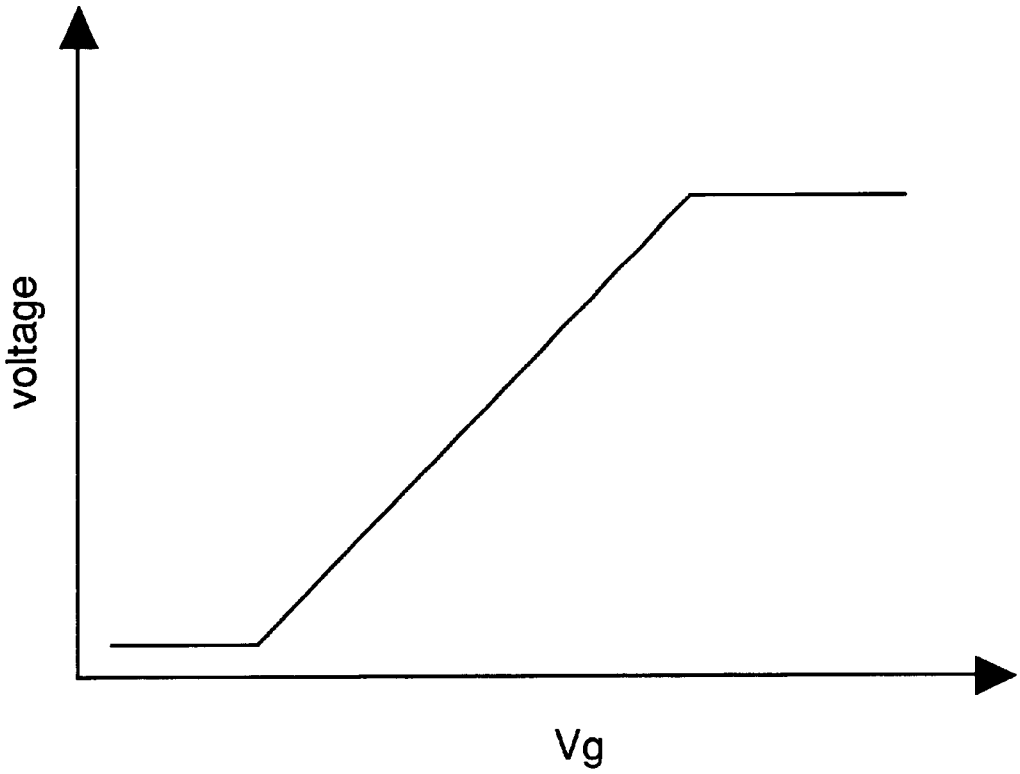
FIG. 6 is a graph showing still another relationship between the gate voltage of each thin-film transistor of the impedance element and the voltage applied to the liquid crystal layer.

FIG. 6 is a graph showing still another relationship between the gate voltage (V g) of the thin-film transistors 16 of the impedance element 13 and the voltage applied to the liquid crystal layer 12. This example employs a control method that is different from the above ones.

In this example, the three thin-film transistors 16 change from an off-state to an on-state at slightly different gate voltage values. As the gate voltage is increased, the three thin-film transistors 16 are turned on gradually one after another. Therefore, the voltage applied to the liquid crystal layer 12 can be varied gently with respect to the gate voltage. As a result, a halftone image can be displayed in a stable manner and hence the display quality can be improved.

Although in the above examples the number of thin-film transistors 16 and the number of voltage dividing capacitors 15 are three, the invention is not limited to such a case. Finer halftone imaging display can be performed by increasing the number of parallel-connected sets of the thin-film transistor 16 and the voltage dividing capacitor 15.

In this embodiment, a display signal may be sent directly from the peripheral circuit to the pixels in the form of digital information. In this case, the number of wiring lines increases with the number of bits of digital data. Therefore, the aperture ratio may decrease when such a data transfer method is applied to a transmission-type liquid crystal display device. On the other hand, it can easily be applied to a reflection-type liquid crystal display device.

Another data transfer method is possible in which a display signal is sent to the pixels in the form of analog information such as a signal line voltage and converted to digital information at each pixel. A voltage applied to the pixel electrode is controlled by changing the impedance value of the impedance element 13 in accordance with the digital display signal thus produced.

Embodiment 2

Figure 7:
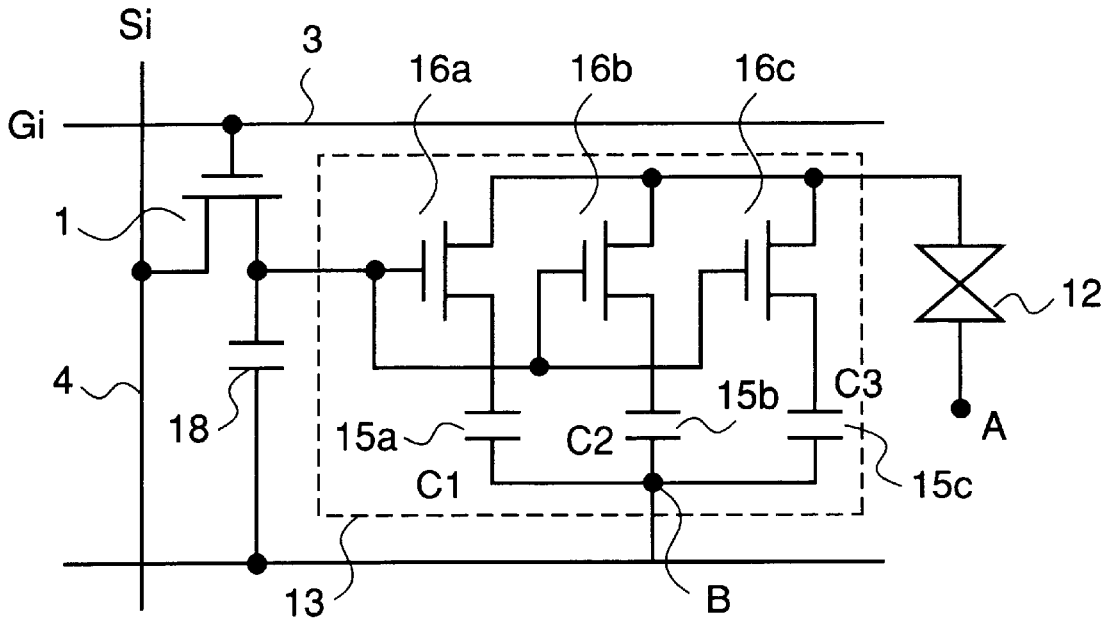
FIG. 7 is an equivalent circuit diagram schematically showing the configuration of an example of a unit pixel of a liquid crystal display device according to a second embodiment of the invention.

FIG. 7 is an equivalent circuit diagram schematically showing the configuration of an example of a unit pixel of a liquid crystal display device according to a second embodiment of the invention.

A thin-film transistor 1 is provided for pixel selection. The thin-film transistor 1 is on/off-controlled by a scanning signal that is supplied to a scanning line 3; the thin-film transistor 1 samples a display signal being supplied to a signal line 4 when it is in an on-state. The sampled display signal is stored in an auxiliary capacitor (Cs) 18 as a voltage corresponding to the display signal. The load capacitance as viewed from the thin-film transistor 1 is a combined capacitance of thin-film transistors 16*a*–16*c* and voltage dividing capacitors 15*a*–15*c* that constitute an impedance element 13 and the auxiliary capacitor 18. The combined capacitance can be set much smaller than the liquid crystal capacitance 12. Therefore, the time to write a display signal to the liquid crystal layer 12 can be made much shorter than in the case of the conventional liquid crystal display device shown in FIG. 29 and the signal writing can be completed in a very short time. As a result, the number of scanning lines of the liquid crystal display device can be increased, thereby making it easier to increase the number of pixels.

In the configuration shown in FIG. 7, a display signal held by the auxiliary capacitor 18 is applied to the gate electrodes of the respective thin-film transistors 16*a*–16*c*. The thin-film transistors 16*a*–16*c* are on/off-switched in accordance with the gate electrode potential. Since the voltage dividing capacitors 15*a*–15*c* are inserted between an electrode B and the thin-film transistors 16*a*–16*c*, respectively, the gate-source voltages of the respective thin-film transistors 16*a*–16*c* are different from each other depending on the capacitance values C1–C3 of the respective capacitors 15*a*–15*c*. Therefore, the thin-film transistors 16*a*–16*c* are turned on or off at different time points, whereby the voltage characteristic shown in FIG. 6 are realized.

Figure 8:
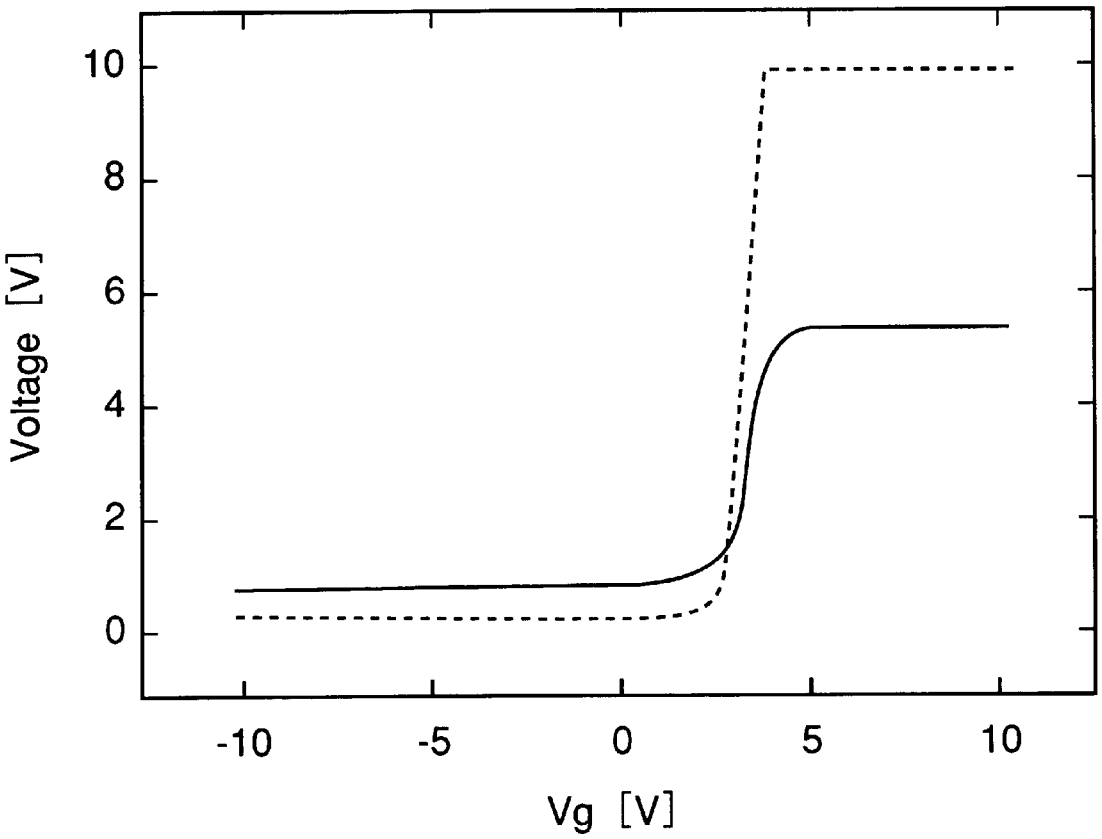
FIG. 8 is a graph showing an example of a liquid crystal application voltage characteristic that is obtained when the capacitance values of voltage dividing capacitors are adjusted based on the electrical characteristics of thin-film transistors.

FIG. 8 is a graph showing relationship between the gate voltage (V g) of the thin-film transistors 16*a*, 16*b*, 16*c* of the impedance element 13 and the voltage applied to the liquid crystal layer 18. The solid line in FIG. 8 indicates a liquid crystal application voltage characteristic in a case where the capacitance values C1–C3 of the capacitors 15*a*–15*c* are 50 fF, 130 fF, and 200 fF, respectively, and the liquid crystal capacitance that constitutes the unit pixel is 300 fF. The broken line in FIG. 8 indicates a liquid crystal application voltage characteristic of the conventional liquid crystal display device shown in FIG. 29. It is understood from a comparison between the two characteristics that in the liquid crystal display device of the embodiment the liquid crystal application voltage changes more gently with respect to the gate voltage Vg than in the conventional liquid crystal display device. In this manner, the liquid crystal display device of the embodiment makes it possible to control the halftone imaging display more easily.

Figure 9:
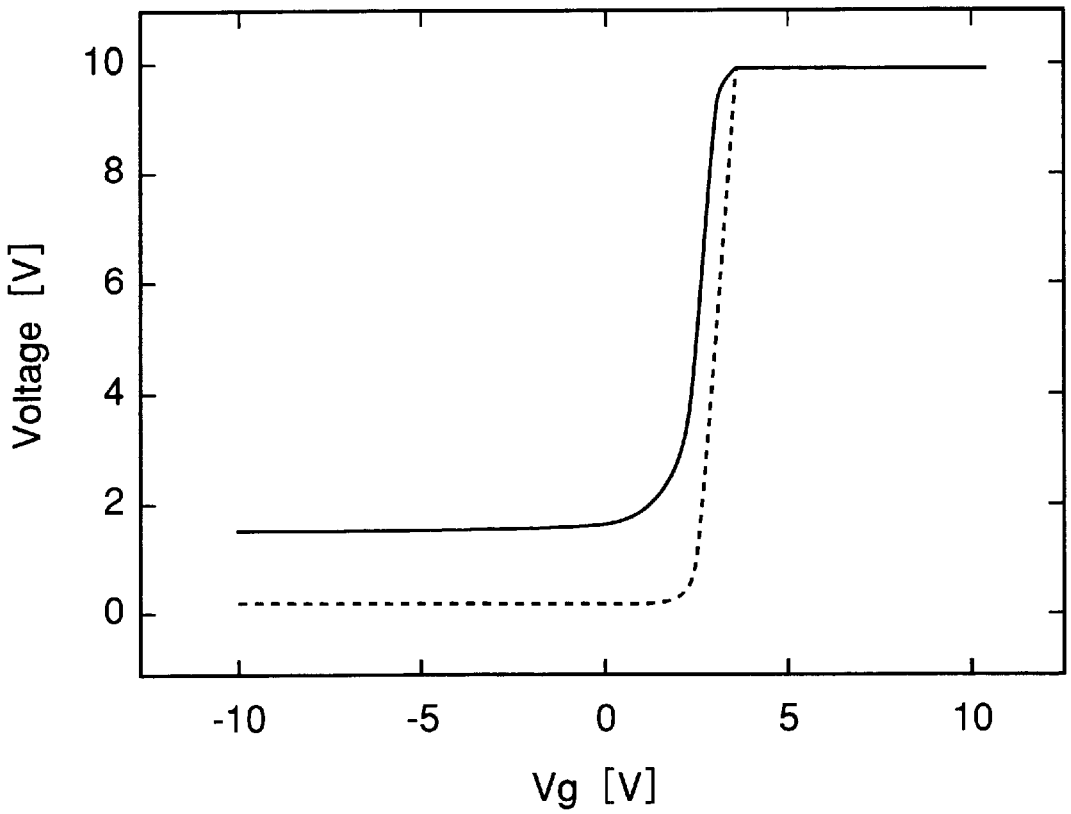
FIG. 9 is a graph showing an example of a liquid crystal application voltage characteristic that is obtained when six thin-film transistors are connected together in parallel.

The solid line in FIG. 9 indicates an example liquid crystal application voltage characteristic that is obtained when six thin-film transistors are connected together in parallel. The broken line in FIG. 9 indicates a characteristic that is obtained when only one thin-film transistor is used. Where more thin-film transistors are used, although the potential level is higher when no voltage is applied to the liquid crystal layer 12, as a whole the liquid crystal application voltage varies more gently with respect to the gate voltage, which is advantageous for halftone display.

Embodiment 3

Figure 10:
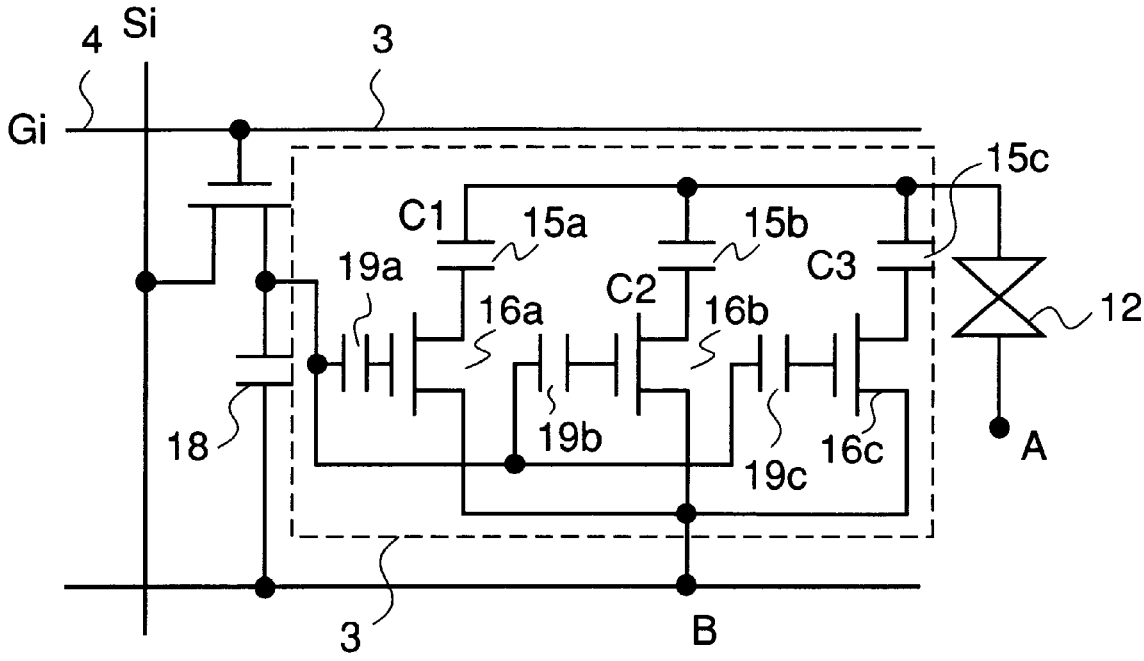
FIG. 10 is an equivalent circuit diagram schematically showing the configuration of an example of a unit pixel of a liquid crystal display device according to a third embodiment of the invention.

FIG. 10 is an equivalent circuit diagram of a unit pixel of a liquid crystal display device according to a third embodiment of the invention.

As in the case of the liquid crystal display device shown in FIG. 7, a display signal sampled by a thin-film transistor 1 for pixel selection is written to an auxiliary capacitor 18. Thin-film transistors 16*a*–16*c* of an impedance element 13 are on/off-controlled in accordance with the voltage of the display signal stored in the auxiliary capacitor 18.

In this embodiment, additional capacitors 19*a*–19*c* are inserted between the auxiliary capacitor 18 and the gates of the thin-film transistors 16*a*–16*c*, respectively. The gate-source voltages of the thin-film transistors 16*a*–16*c* are controlled in accordance with the capacitances of the additional capacitors 19*a*–19*c*, respectively. The time points when the thin-film transistors 16*a*–16*c* are turned on or off are shifted from each other, whereby the voltage characteristic shown in FIG. 4 or 6 is realized.

Figure 11:
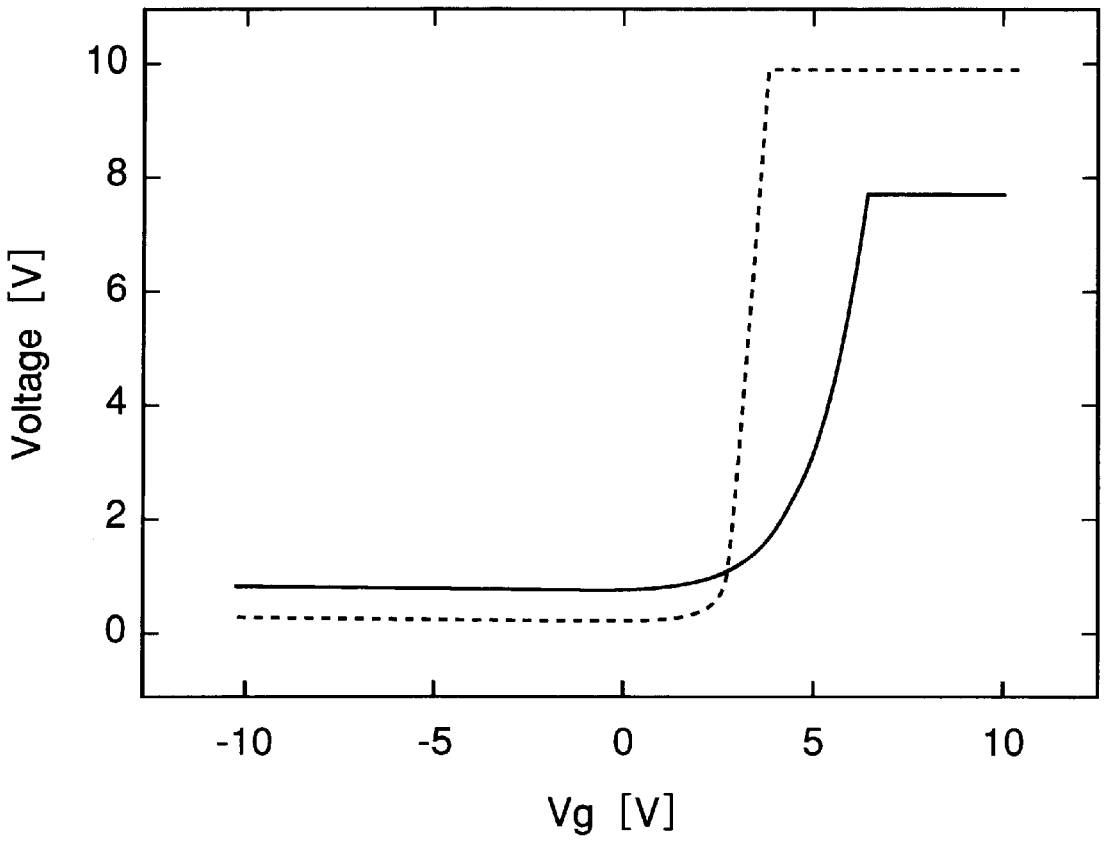
FIG. 11 is a graph showing an example of a liquid crystal application voltage characteristic of the liquid crystal display device according to the third embodiment.

FIG. 11 is a graph showing an example of a liquid crystal application voltage characteristic of the liquid crystal display device of this embodiment that is obtained when the capacitance values C1–C3 of voltage dividing capacitors 15*a*–15*c* are set at 100 fF, 300 fF, and 800 fF, respectively, and the capacitance values of the additional capacitors 19*a*–19*c* are set at 50 fF, 34 fF, and 30 fF, respectively. It is understood that the liquid crystal application voltage varies more gently with respect to the gate voltage Vg than in the case of a characteristic (indicated by a broken line in FIG. 11) of the conventional liquid crystal display device of FIG. 29. As such, the liquid crystal display device of this embodiment makes it possible to control the halftone imaging display more easily.

Embodiment 4

Figure 12:
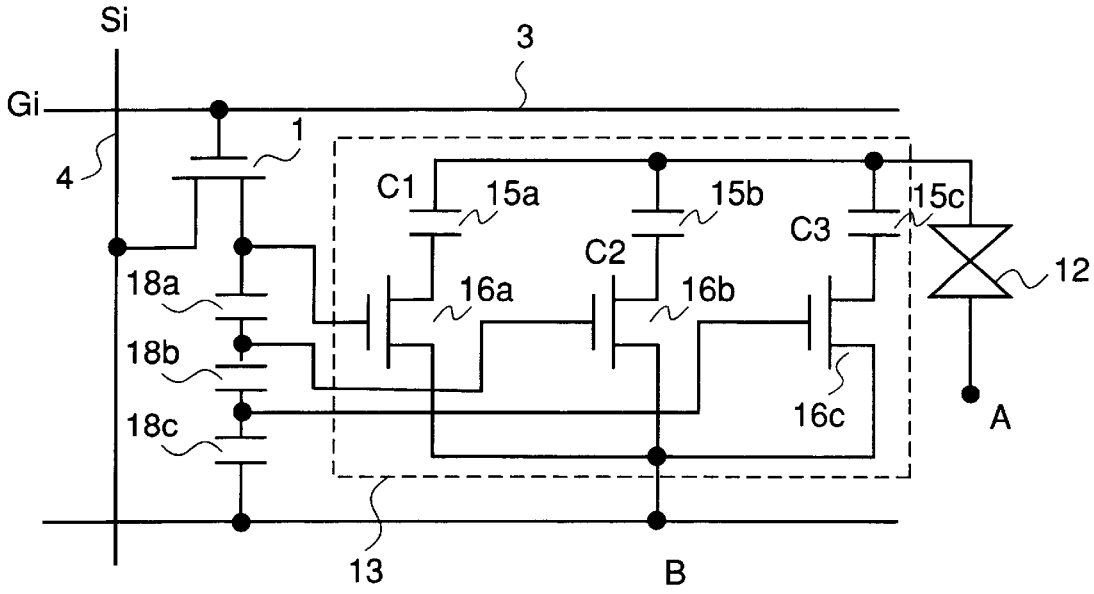
FIG. 12 is an equivalent circuit diagram schematically showing the configuration of an example of a unit pixel of a liquid crystal display device according to a fourth embodiment of the invention.

FIG. 12 is an equivalent circuit diagram showing the configuration of a unit pixel of a liquid crystal display device according to a fourth embodiment of the invention.

In this liquid crystal display device, the auxiliary capacitor 18 is replaced by capacitors 18*a*–18*c* and capacitance-divided voltages of a display signal being held are applied to the gates of respective thin film transistors 16*a*–16*c*.

Figure 13:
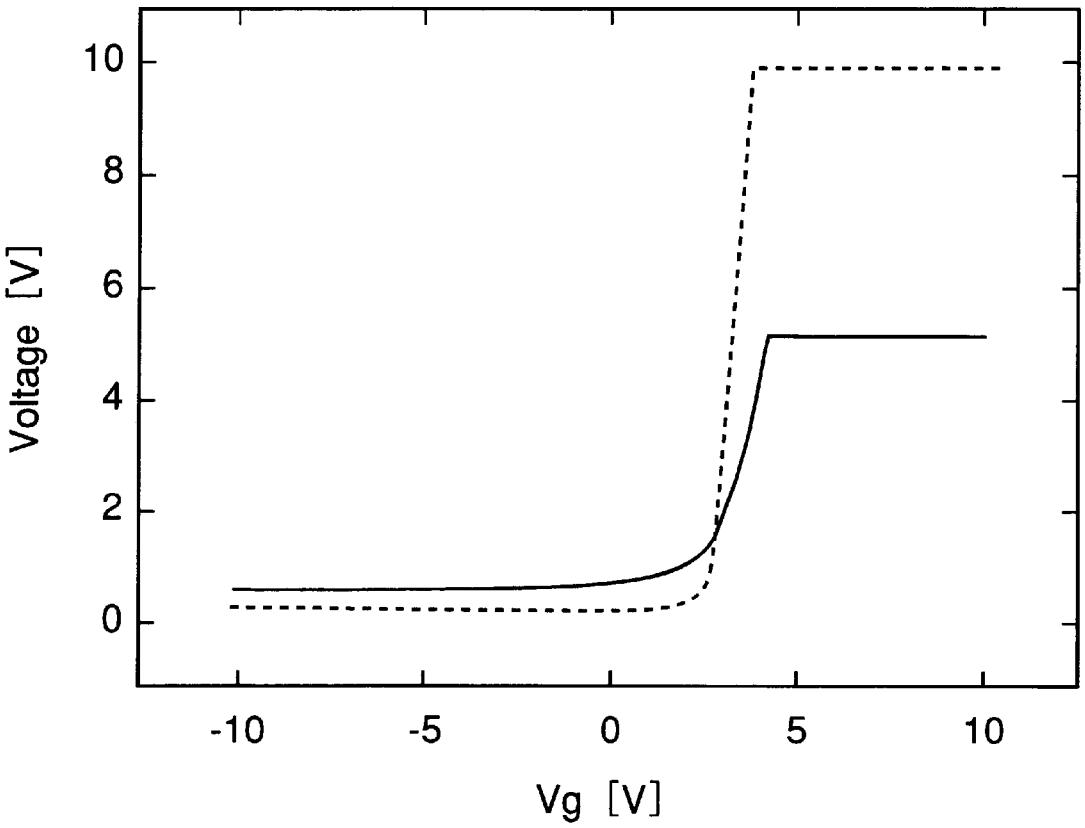
FIG. 13 is a graph showing an example of a liquid crystal application voltage characteristic of the liquid crystal display device according to the fourth embodiment.

FIG. 13 is a graph showing an example of a liquid crystal application voltage characteristic of the liquid crystal display device of this embodiment that is obtained when the capacitance values C1–C3 of voltage dividing capacitors 15*a*–15*c* are set at 50 fF, 150 fF, and 50 fF, respectively, and the capacitance values Cs1–Cs3 of the auxiliary capacitors 18*a*–18*c* are set at 50 fF, 50 fF, and 150 fF, respectively.

Figure 29:
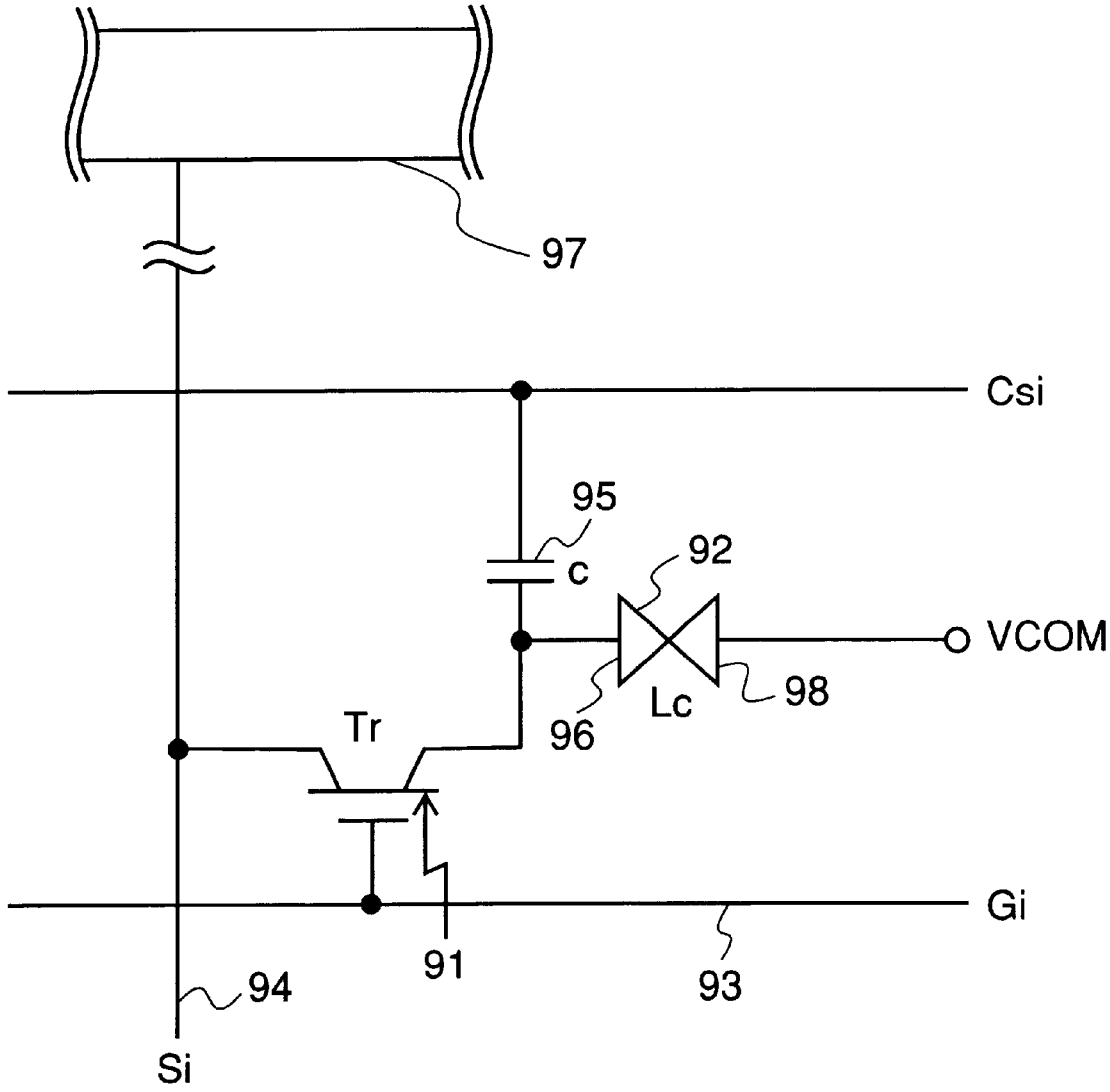
(prior art) Fig.29
FIG. 29 schematically shows the configuration of an example of a conventional liquid crystal display device.

It is understood that the liquid crystal application voltage varies more gently with respect to the gate voltage Vg than in the case of a characteristic (indicated by a broken line in FIG. 13) of the conventional liquid crystal display device of FIG. 29. As such, the liquid crystal display device of this embodiment makes it possible to control the halftone imaging display more easily.

Figure 14:
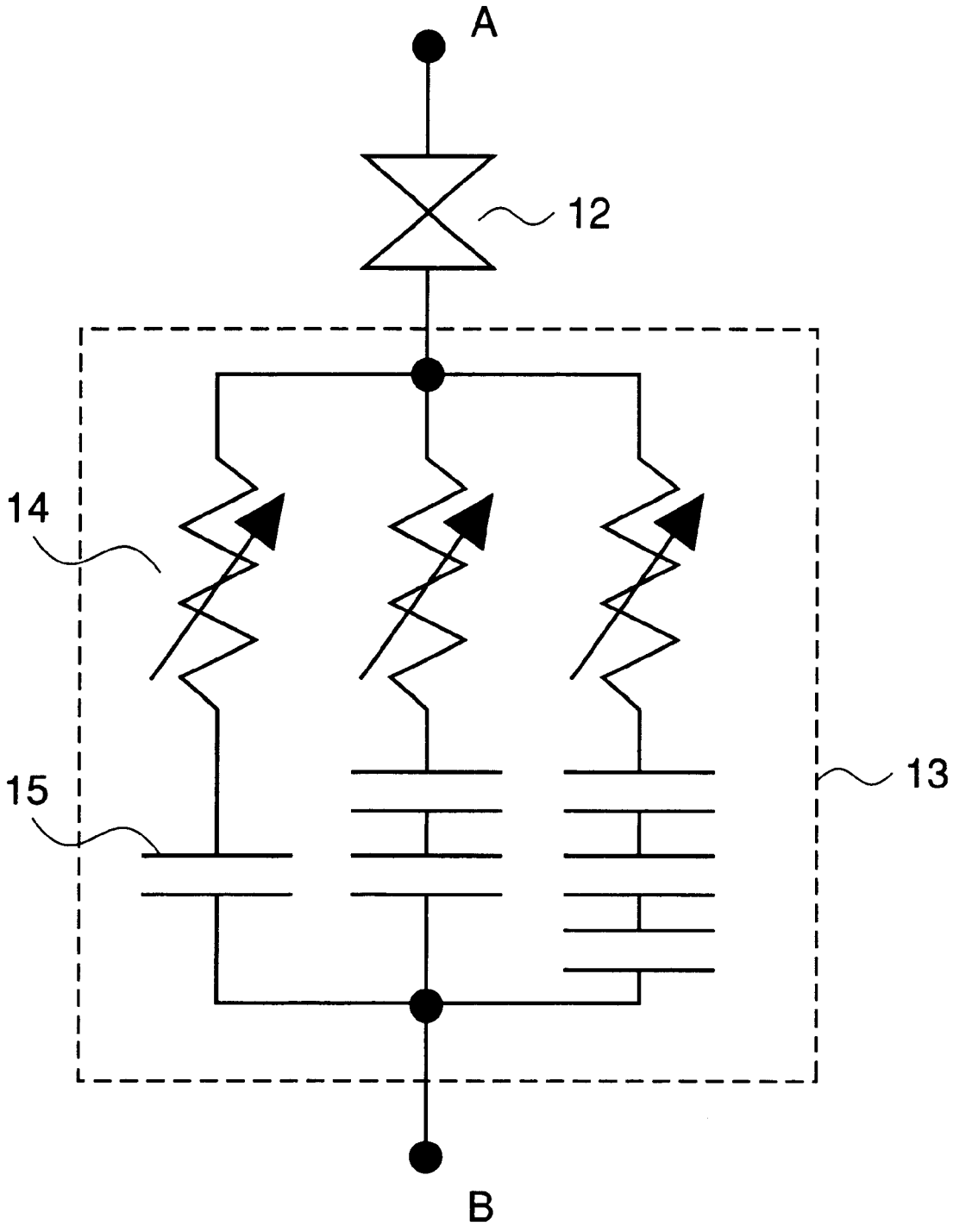
FIG. 14 shows the configuration of another example of a unit pixel of a liquid crystal display device according to the fourth embodiment.

Although in this embodiment the number of capacitors having the same capacitance value and connected to each other in series may be changed as shown in FIG. 14.

Embodiment 5

Figure 15:
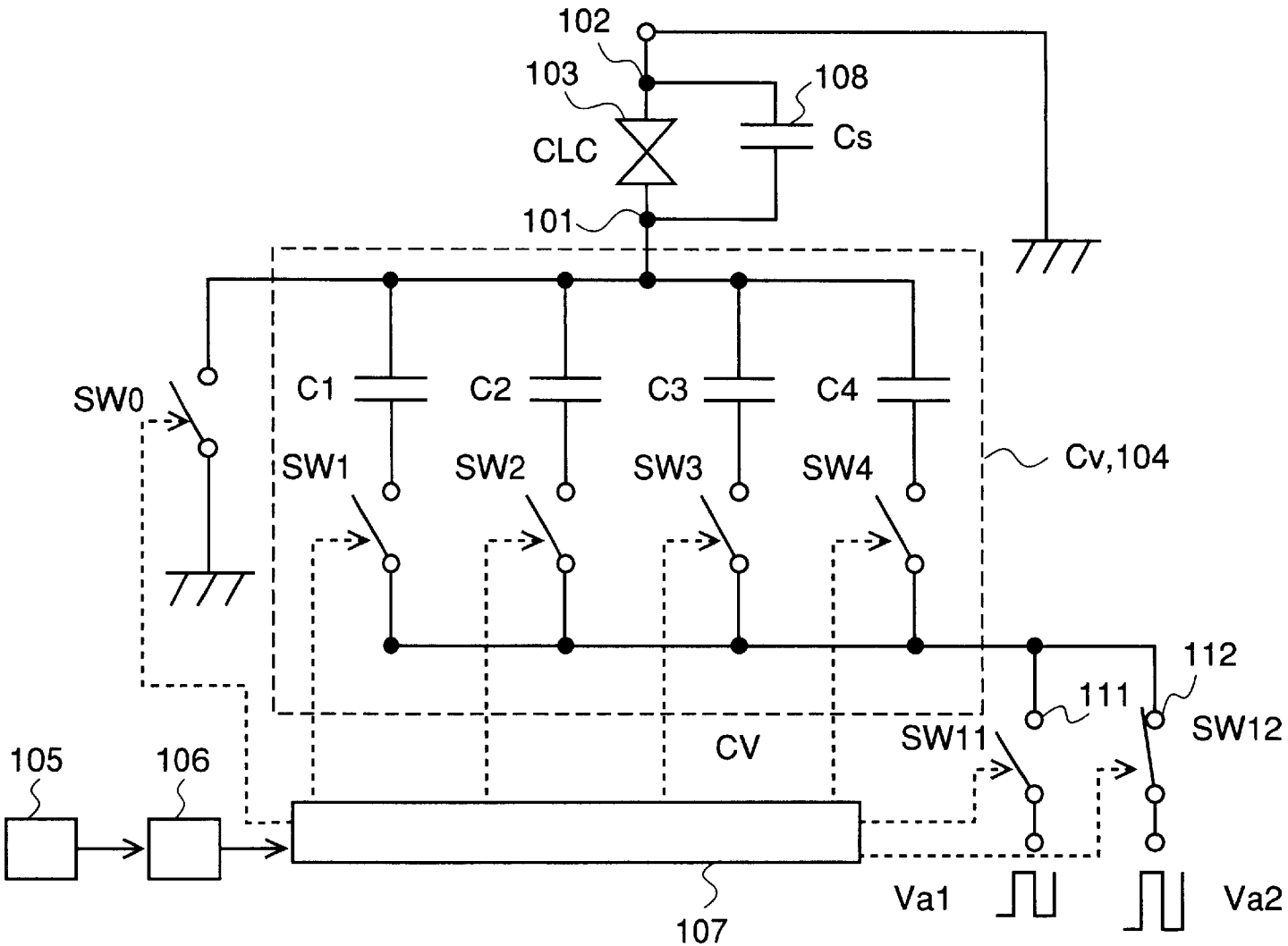
FIG. 15 schematically shows the configuration of a liquid crystal display device according to a fifth embodiment of the invention.

FIG. 15 is an equivalent circuit diagram of a liquid crystal display device according to a fifth embodiment of the invention.

In this liquid crystal display device, a liquid crystal layer 103 is held between an array substrate on which pixel electrodes 101 are arranged in matrix form and an opposed substrate on which an opposed electrode 102 is provided. The unit pixel consists of the pixel electrode 101, the opposed electrode 102, and the liquid crystal layer 103 interposed in between.

A variable capacitance element 104 is connected to the pixel electrode 101 of each pixel. The variable capacitance element 104 is configured in such a manner that capacitors C1–C4 are connected in series to respective switches SW1–SW4 and the series connections of a capacitor and a switch are connected together in parallel. In this embodiment, the switches SW1–SW4 of the variable capacitance element 104 are switched by a control circuit 107 in accordance with a display signal that is supplied from a display signal supply system 105 and selected by a selection circuit 106.

Therefore, the capacitance of the variable capacitance element 104 is varied in accordance with a display signal that is selected for each pixel.

Although in the above example the variable capacitance element 104 includes four capacitors that are connected together in parallel, the number of capacitors may be either larger than four or smaller than four (but should not be smaller than two). Although in the above example all the capacitors are connected together in parallel, capacitors may be connected to each other in series and in parallel in a mixed manner. In the case of a series connection, a switch may be connected in parallel to a capacitor.

In the liquid crystal display device of this embodiment, AC voltages having different amplitudes can be supplied to the variable capacitance element 104 from a plurality of AC voltage supply systems. In the example of FIG. 15, there are a first AC voltage supply system 111 for supplying a first AC voltage Va1 and a second AC voltage supply system 112 for supplying a second AC voltage Va2. Switches SW11 and SW12 are inserted between the variable capacitance element 104 and the respective AC voltage supply systems 111 and 112.

In the device of FIG. 15, the switches SW11 and SW12 are also switched by the control circuit 107 in accordance with a selected display signal. Therefore, AC voltages having different amplitudes are selectively applied to the variable capacitance element 104 in accordance with a display signal. Further, in this device, an auxiliary capacitor (Cs) 18 is connected in parallel to a liquid crystal capacitance $C_{LC}$ in an AC-like manner. In addition, a switch SW0 for resetting the voltage of the pixel electrode 101 is provided.

As described above, the switches SW1–SW4 and SW11–SW12 are on/off-controlled by the control circuit 107 that is provided for each pixel. The control circuit 107 is a decoder or a matrix circuit, for example, and the switching is made based on a display signal that is selected for each pixel. The display signal may be either an analog signal or a digital signal. For example, a configuration is possible in which the display signal is digital data and held by a memory in the control circuit 107. The control circuit 107 needs to be configured so that its output state does not vary at least until a display signal rewriting period. For example, the switches SW1–SW4 and SW11–SW12 may be field-effect transistors such as thin-film transistors.

Figure 16:
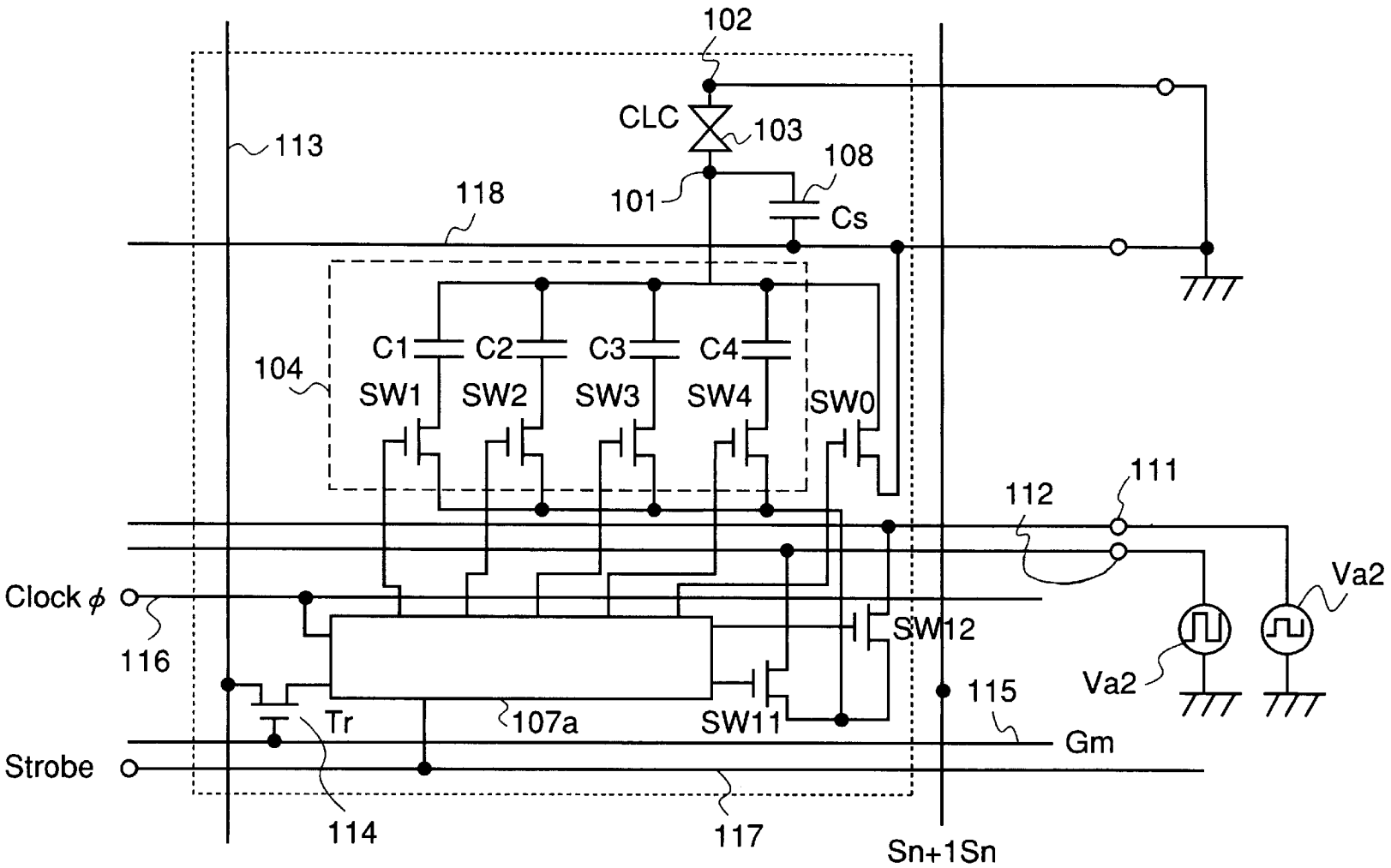
FIG. 16 shows the configuration of a more specific example of the liquid crystal display device according to the fifth embodiment.

FIG. 16 shows a more specific example of the liquid crystal display device according to this embodiment. A decoder 107*a* is used as the control circuit 107 for controlling the capacitance of the variable capacitance element 104 and switching among the plurality of AC voltage supply systems that are connected to the variable capacitance element 104.

A clock line 116 for supplying a clock signal, the output line of a thin-film transistor 114 that is connected to a signal line 113 and a scanning line 115, and a strobe line 117 are connected to the decoder 107*a*. Reference numeral 118 denotes a Cs line. Power sources etc. are not shown in FIG. 16.

In this example, the switches SW1–SW4 and SW11–SW12 are thin-film transistors in which the channel semiconductor film is made of a semiconductor such as amorphous silicon, polysilicon, or single crystal silicon. The thin-film transistors may be made of other semiconductor materials such as CdSe.

Next, the operation of the liquid crystal display device of this embodiment shown in FIG. 16 will be described.

In this liquid crystal display device, a display signal is supplied from a signal line driver circuit (not shown) to the signal line 113 and selected by the thin-film transistor 114 for pixel selection. The selected display signal is supplied to the decoder 107*a*. That is, the thin-film transistor 114 is on/off-controlled by a scanning signal that is supplied from a scanning line driver circuit (not shown) to the scanning line 115, and a display signal that is applied to the signal line 113 when the thin-film transistor 114 is turned on is supplied to the decoder 107*a* via the source and drain of the thin-film transistor 114.

The decoder 107*a* as the control circuit 107 on/off-controls the switches SW1–SW4 and SW11–SW12 in accordance with the display signal.

The capacitance Cv of the variable capacitance element 104 is the sum of the capacitance values of capacitors that are connected to switches in an on-state. Now, control signals for the switches SW1–SW4 are represented by x1–x4, respectively, and a function δ(x) is defined as taking a value "1" when the corresponding switch is on and a value "0" when the corresponding switch is off. The capacitance Cv is given by $$Cv=C1\times\delta(x)+C2\times\delta(x2)+C3\times\delta(x3)+C4\times\delta(x4). \quad (1)$$

Therefore, when the variable capacitance element 104 have four capacitors, that is, the capacitors C1–C4, it can have $2^4$ (=16) kinds of capacitance values by changing the combination of the capacitors C1–C4.

A voltage $V_{LC}$ that is applied to the liquid crystal layer 103 is given by $$V_{LC}=Va\times Cv/(Cv+C_{LC}+Cs) \quad (2)$$

where Va is the amplitude of an AC voltage that is applied to the series connection of the variable capacitance element (Cv) 103 and the capacitance that is composed of the liquid crystal layer 103 and the auxiliary capacitor 108.

One of the first AC voltage Va1 and the second AC voltage Va2 is selected through turning-on/off of the switches SW11 and SW12 by the decoder 107*a,* and applied to the variable capacitance element 104 as the voltage Va.

Where Va1 is set at ½ of Va2, the capacitance values C1–C4 are set as shown in FIG. 20 in terms of a ratio to Cp=$C_{LC}$+Cs.

Figure 17:
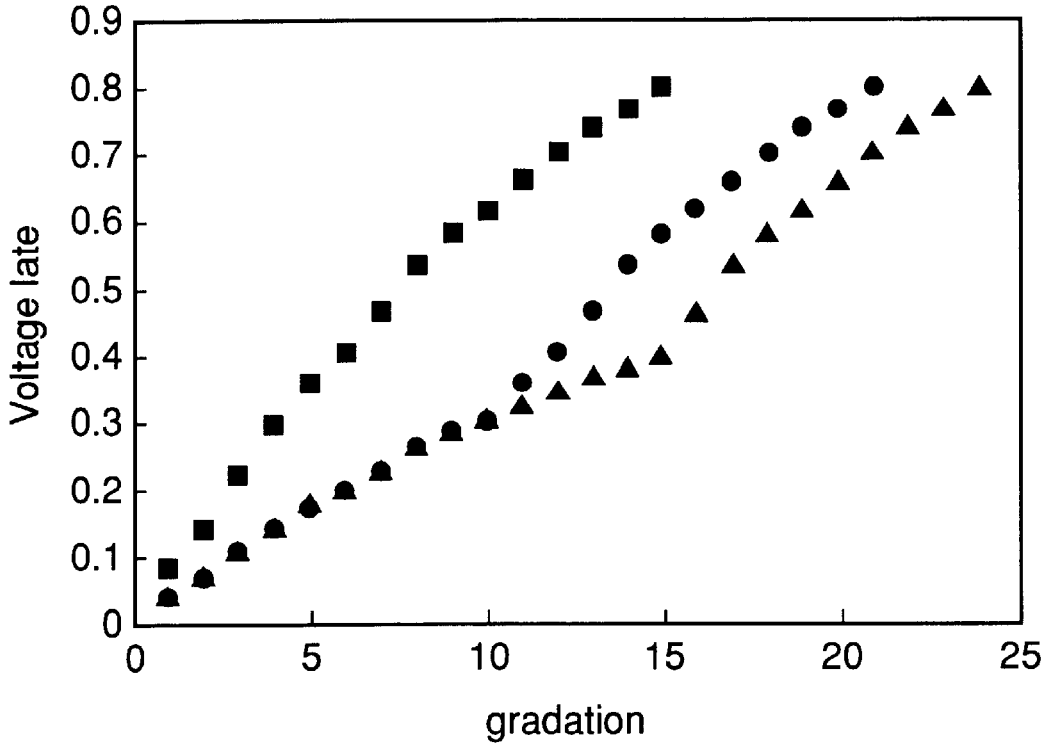
FIG. 17 is a graph showing an example relationship between the display gradation level and the liquid crystal application voltage in the liquid crystal display device according to the fifth embodiment.

FIG. 17 is a graph showing a relationship between the display gradation level and the liquid crystal application voltage in the liquid crystal display device of this embodiment. Square plots correspond to a case where a single voltage source having the same amplitude as Va2 is employed. In this case, the voltage ratio varies in a range of 0–0.8 in 16 levels (corresponding to 16 gradation levels) with steps as shown in FIG. 17. On the other hand, circular plots correspond to a case where Va1 is selected in a gradation range of 0–10 and Va2 is selected in a gradation range of 11–21 (switching is made at a voltage ratio 0.3). Triangular plots correspond to a case where Va1 is selected in a gradation range of 0–15 and Va2 is selected in a gradation range of 16–24 (switching is made at a voltage ratio 0.4). It is understood that the number of gradation levels can be increased by switching between AC voltages. Further, the voltage variation steps can be made finer on the low-voltage side, which means that in a normally-black mode finer gradation levels can be obtained in a dark range. In view of the luminous efficiency, it is necessary to provide many gradation levels in a dark range instead of providing gradation levels at regular intervals. This is realized by the above-type of switching between AC voltages.

Although the gradation level vs. voltage ratio curve is bent at the switching point, the bending can be compensated for by adding correction values reflecting the bending characteristic to a correction characteristic of a gamma correction circuit for correction of a relationship between the display level and the gradation level.

This embodiment can be modified in the following manners to provide various additional advantages.

The capacitance values of the capacitors C1–C4 may be made infinite; that is, the capacitors C1–C4 may be removed to connect the liquid crystal layer 103 directly to the switches SW11 and SW12. This configuration provides an advantage that the efficiency of the liquid crystal application voltage can be increased.

The auxiliary capacitance Cs is effective in properly controlling the way the denominator of Equation (2) varies as the liquid crystal capacitance $C_{LC}$ varies depending on the application voltage. For example, the capacitance variation can be inhibited by making the auxiliary capacitance Cs about 1–10 times the minimum value of the liquid crystal capacitance $C_{LC}$. Conversely, the liquid crystal application voltage can be changed by utilizing the variation of the liquid crystal capacitance $C_{LC}$. Therefore, the capacitance Cs of the auxiliary capacitor 108 may be set at a value suitable for that purpose rather than a large value as mentioned above. The auxiliary capacitor 108 may even be omitted.

Further, the capacitance Cs of the auxiliary capacitor 108 may be made variable by using switches like the capacitance Cv of the variable capacitance element 104. This configuration makes it possible to vary the amplitude of the liquid crystal application voltage greatly.

The phases of the first AC voltage Va1 and the second AC voltage Va2 may be the same or opposite or may be shifted from each other by a proper amount. Shifting the phases somewhat from each other in accordance with the amplitudes of the AC voltages can reduce noise that is caused through capacitive coupling of the AC voltages with the signal line 113 or the pixel electrode 101. Equalizing the supply phases of the AC voltages makes it possible to simplify the configuration of an external AC voltage generation circuit. The AC voltages may be rectangular waves, sinusoidal waves, or the like. Further, electromagnetic noise emission can be inhibited by rounding the rise and fall portions of the waveforms of the AC voltages.

A configuration is possible in which the switch SW0 is turned on to fix the pixel electrode potential before the selection states of the switches SW1–SW4 are determined, and then the switch SW0 is turned off and an AC voltage is applied via the switches SW1–SW4. This prevents application of an unnecessary DC voltage to the liquid crystal layer 103 and thereby prevents screen burning or an afterimage.

The switch SW0 zeros the liquid crystal application voltage when the switches SW1–SW4 are turned off. However, keeping for a long time the state that the switch SW0 is turned on is problematic because it renders the potential of the liquid crystal layer 103 in a floating state. Therefore, the switch SW0 may be used to fix the liquid crystal application voltage to 0 V. With this configuration, the switch SW0 may be omitted.

In particular, capable of facilitating the circuit designing, the invention can be applied suitably to a case where, as in the case of a pixels/peripheral driver circuits integration type liquid crystal display device, the switches SW1–SW4 and SW11 and SW12 and the pixel selection switching element 114 that are provided in each pixel and thin-film transistors constituting peripheral driver circuits are integrated on a substrate by forming those elements in the form of p-Si TFTs, $\mu$c-Si TFTs, or the like that use polysilicon as a channel semiconductor film.

The strobe line 117 serves to cause the decoder 107*a* to produce outputs simultaneously. For example, a strobe signal may be enabled after the pixel selection period. This prevents application of a voltage to the liquid crystal layer 103 in the midst of rewriting of one pixel, whereby the display quality can be improved.

If the write time (selection time) is short and hence the write time causes substantially no problem in the optical response of the liquid crystal, the strobe signal and the strobe circuit can be omitted.

The auxiliary capacitor 108 is connected to an auxiliary capacitor line 118, which may be connected to the opposed electrode 102 externally in an AC-like manner.

An AC voltage that is separate from the first AC voltage Va1 and the second AC voltage Va2 may be applied to the opposed electrode 102. Further, separate potentials may be applied to the auxiliary capacitor line 118 and the opposed electrode 102 in a DC-like manner, or separate AC voltages may be applied thereto. Applying separate potentials in a DC-like manner makes it easier to commonize the auxiliary capacity line 118 with a power line of the decoder 107*a* or the like or the ground.

In the liquid crystal display device of this embodiment, a display signal to be supplied to the signal line 115 may be a digital signal. Therefore, all the peripheral driver circuits such as a signal line driver circuit may be digital circuits, which makes it possible to dispense with analog portions and thereby avoid deviations in timing as well as to reduce the power consumption within the circuits.

Embodiment 6

Figure 18:
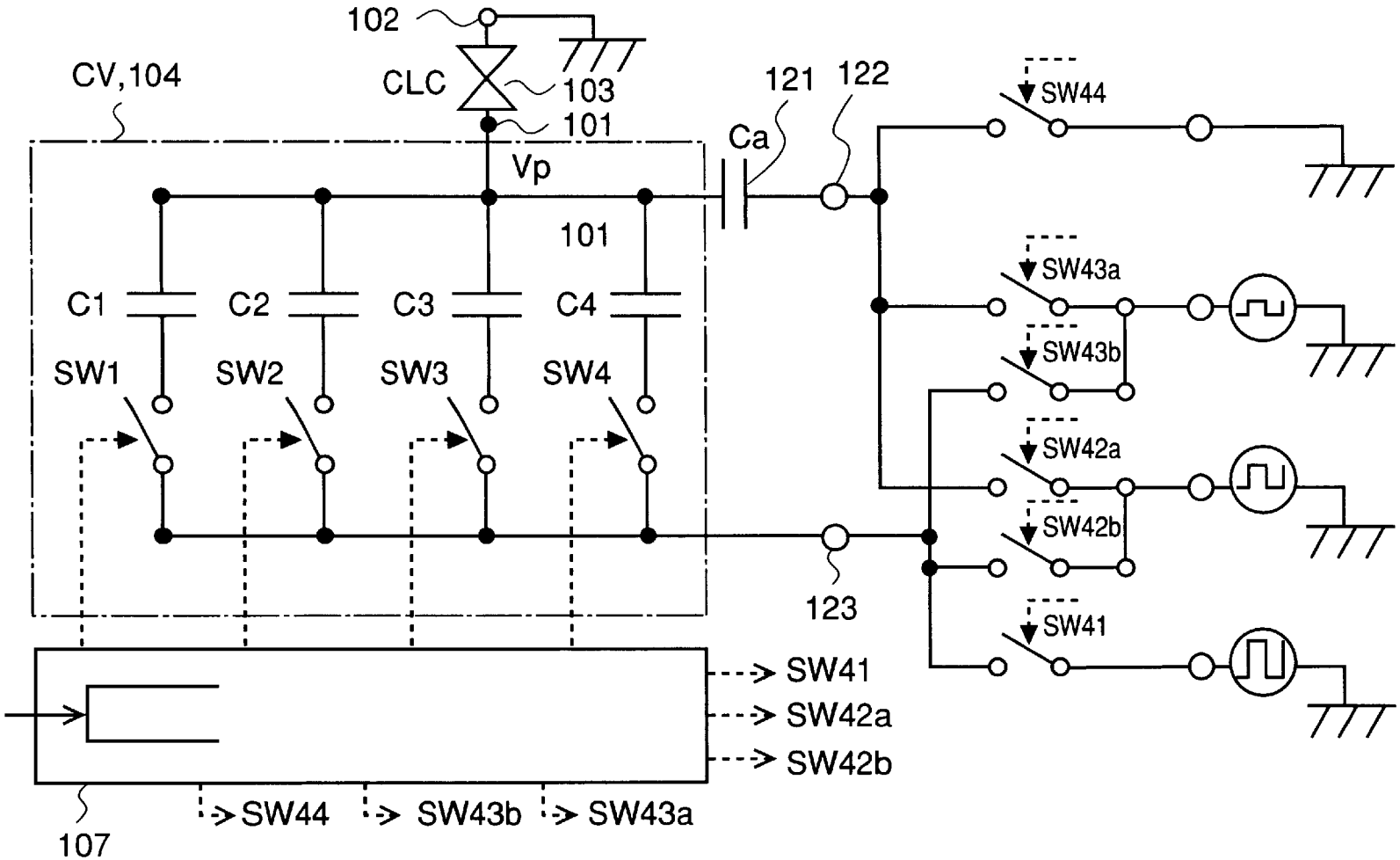
FIG. 18 schematically shows the configuration of a liquid crystal display device according to a sixth embodiment of the invention.
Figure 19:
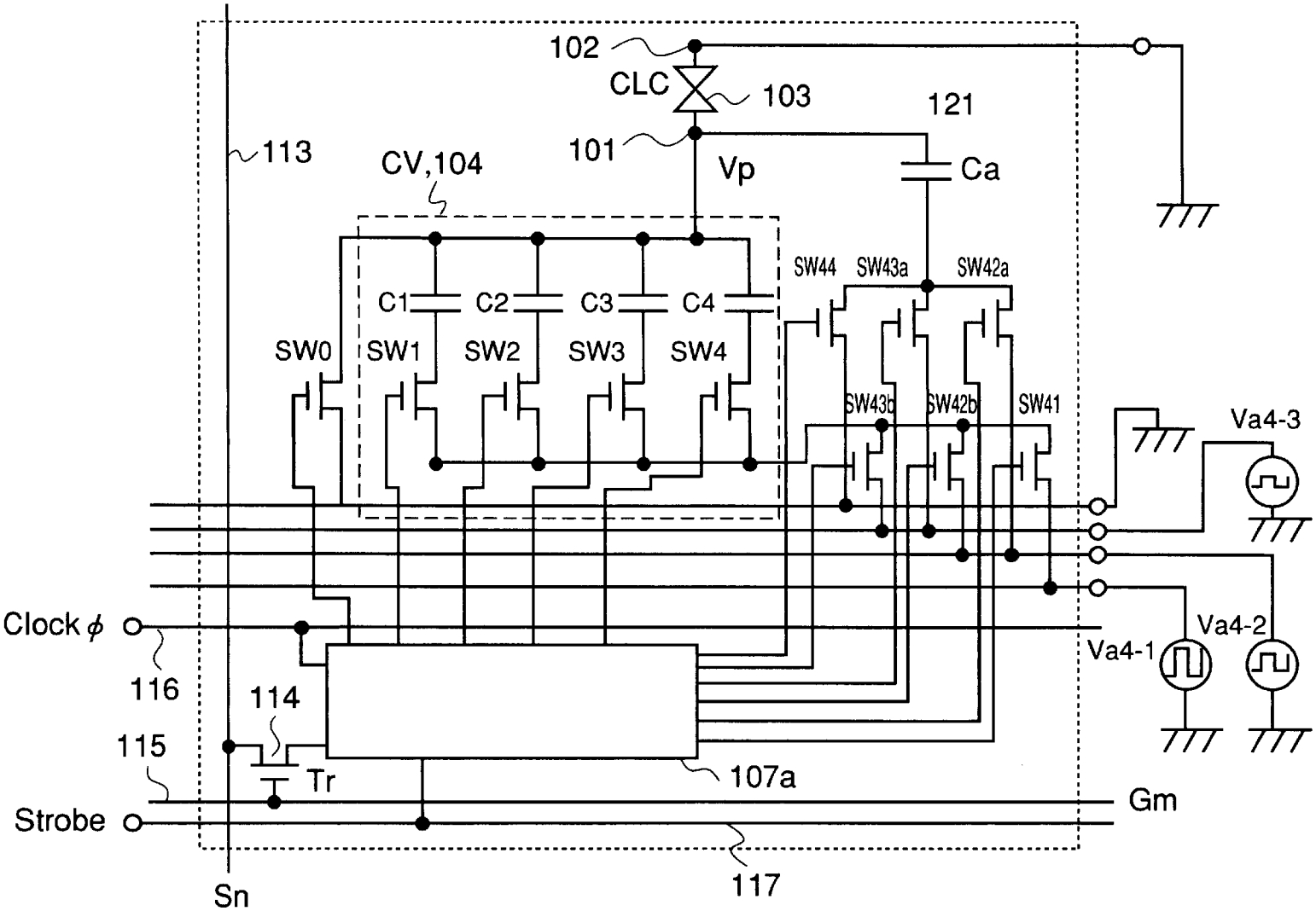
FIG. 19 shows a more specific pixel circuit configuration of the liquid crystal display device according to the fifth embodiment in which a decoder is used as a control circuit.

FIG. 18 schematically shows a liquid crystal display device according to a sixth embodiment of the invention. FIG. 19 shows a more specific pixel circuit configuration in which a decoder is used as a control circuit In this liquid crystal display device, a plurality of AC voltage supply systems are provided so that an AC voltages is applied to each of terminals 122 and 123 between which a series connection of a variable capacitance element (Cv) 104 and an additional capacitor (Ca) 121 are provided.

A voltage to be applied to a liquid crystal layer 103 is specifically applied between an opposed electrode 102 and a pixel electrode 101 that is connected to the connecting point of the variable capacitance element 104 and the additional capacitor 121. If a liquid crystal capacitance $C_{LC}$ is set sufficiently smaller than the combined capacitance of the additional capacitance Ca and the capacitance Cv of the variable capacitance element 104, apixel electrode potential Vp is not varied greatly with the liquid crystal capacitance $C_{LC}$. Alternatively, the pixel electrode voltage Vp may be controlled in consideration of a variation of the liquid crystal capacitance $C_{LC}$.

This example uses three AC voltages having different amplitudes, that is, a first AC voltage Va41, a second AC voltage Va42, and a third AC voltage Va43. However, the number of AC voltages may be four or more. Voltages applied to the terminals 122 and 123 are selected by switching switches SW41, SW42, SW43, and SW44 by a control circuit 107 in accordance with a display signal. Although in this example switching is made between switch application voltages, a separate matrix circuit or the like may be provided.

The pixel application voltage Vp is given by $$Vp=Cv/\{(Cv+Ca)\times Vah\}+Ca/\{(Cv+Ca)\times Val\} \quad (3)$$

where Vah is a Cv-side voltage and Val is a Ca-side voltage. To simplify the discussion, it is assumed that $C_{LC}$ is negligible.

Figure 21:
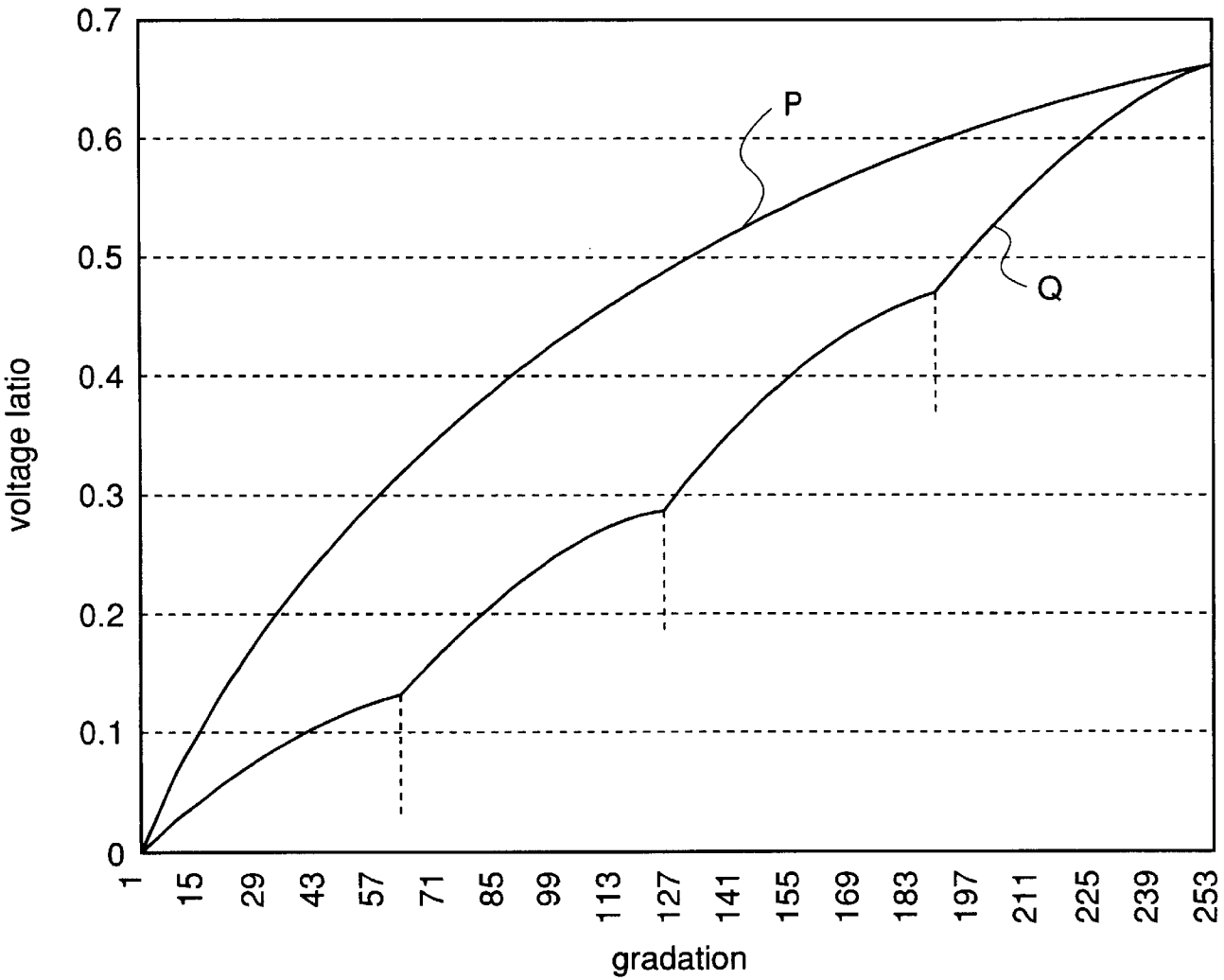
FIG. 21 is a graph showing a relationship between the display gradation level and the application voltage ratio in the liquid crystal display device according to the sixth embodiment.

FIG. 21 is a graph showing a relationship between the display gradation level and the application voltage ratio in the liquid crystal display device of FIGS. 18 and 19 according to this embodiment. FIG. 21 shows voltage ratio values for displaying 256 gradation levels, more specifically, a gradation level vs. voltage ratio curve (Q) of a case where switching is made among four AC voltages (three AC voltages of Va41, Va42, and Va43 and the ground) and a gradation level vs. voltage ratio curve (P) of a case where a single AC voltage supply system is used.

Figure 22:
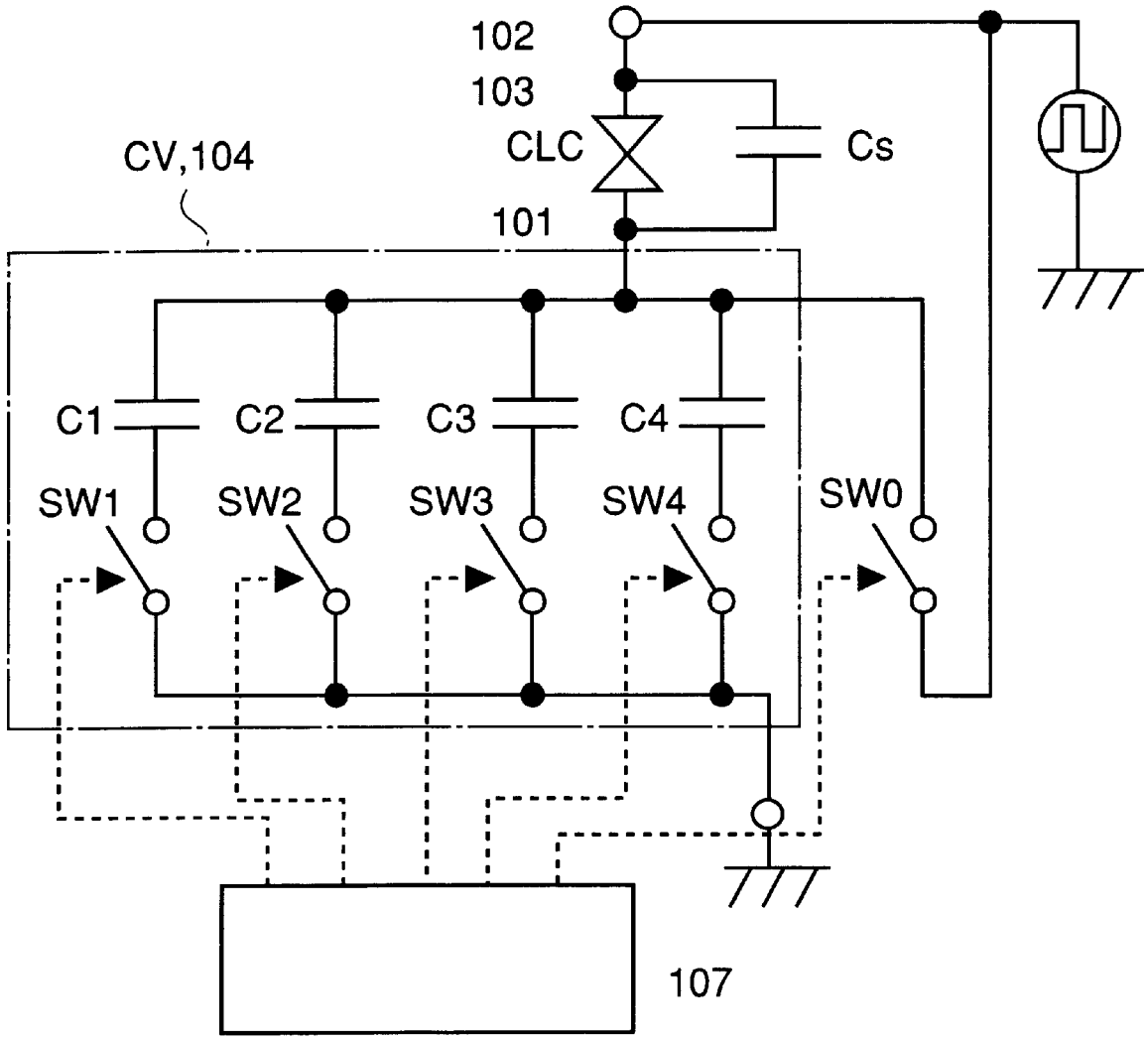
FIG. 22 shows an example circuit configuration of the liquid crystal display device according to the sixth embodiment.

When display was made by using a single AC voltage, a capacitance ratio $\gamma_j$=Cj/Ca that can secure continuity of voltages with eight capacitance values C1–C8 (CLC is assumed negligible) was set as shown in FIG. 27. FIG. 22 shows a circuit configuration employed in this case.

Where switching is made among a plurality of AC voltage supply systems, six capacitance values C1–C6 were set as shown in FIG. 28, for example. The AC voltages were set such that Va1=Va, Va2=0.8 Va, Va3=0.6 Va, and Va4=0.4 Va.

As seen from FIG. 21, when only one AC voltage is used, the voltage variation step decreases as the gradation level increases. In contrast, by switching among four AC voltages, a voltage characteristic that is approximately linear irrespective of the gradation level range can be obtained.

Further, as shown in FIG. 21, the widths of the respective sections can be changed by changing the voltage relationship. The amplitudes of the AC voltages need not always be set at regular intervals. The application voltage can be set with a higher degree of freedom by decreasing the AC voltage intervals for a range where finer gradation levels are desired and increasing those for a range where coarse gradation levels are allowed.

As described above, this embodiment can provide the number of capacitance combinations that is equal to the number of gradation levels necessary for display by setting proper combinations of capacitances while providing a stepped variation of the application voltage freely. As a result, the circuit scales of the driver circuits and the pixel circuit can be minimized and the integration density can be increased.

If the switches are provided in the manner shown in FIG. 18, the voltages Va41 and Va43, for example, can be applied to the terminals 123 and 122 by turning on the switches SW41 and SW43*a,* respectively. This enables a voltage control in a wider range, which means that a finer gradation control can be performed.

The circuit configuration of FIG. 22 provides $2^4$ kinds of capacitance combinations. As indicated by the upper curve of FIG. 21, there may occur a case that not all gradation levels obtained correspond to gradation levels of an actual optical characteristic. In such a case, a gradation correction may be performed in such a manner that the number of gradation levels for actual display is decreased. In other words, a configuration is possible in which in the variable capacitance element 104 capacitors are provided in a number that provides combinations the number of which is larger than a necessary number of display gradation levels and only proper ones of the combinations of those capacitors are selected for display. This configuration may provide a case that a single AC voltage realizes a satisfactory result and hence the circuits can be simplified as a whole. This configuration is particularly effective if an increased part of capacitance combinations cover liquid crystal application voltages.

Embodiment 7

Figure 23:
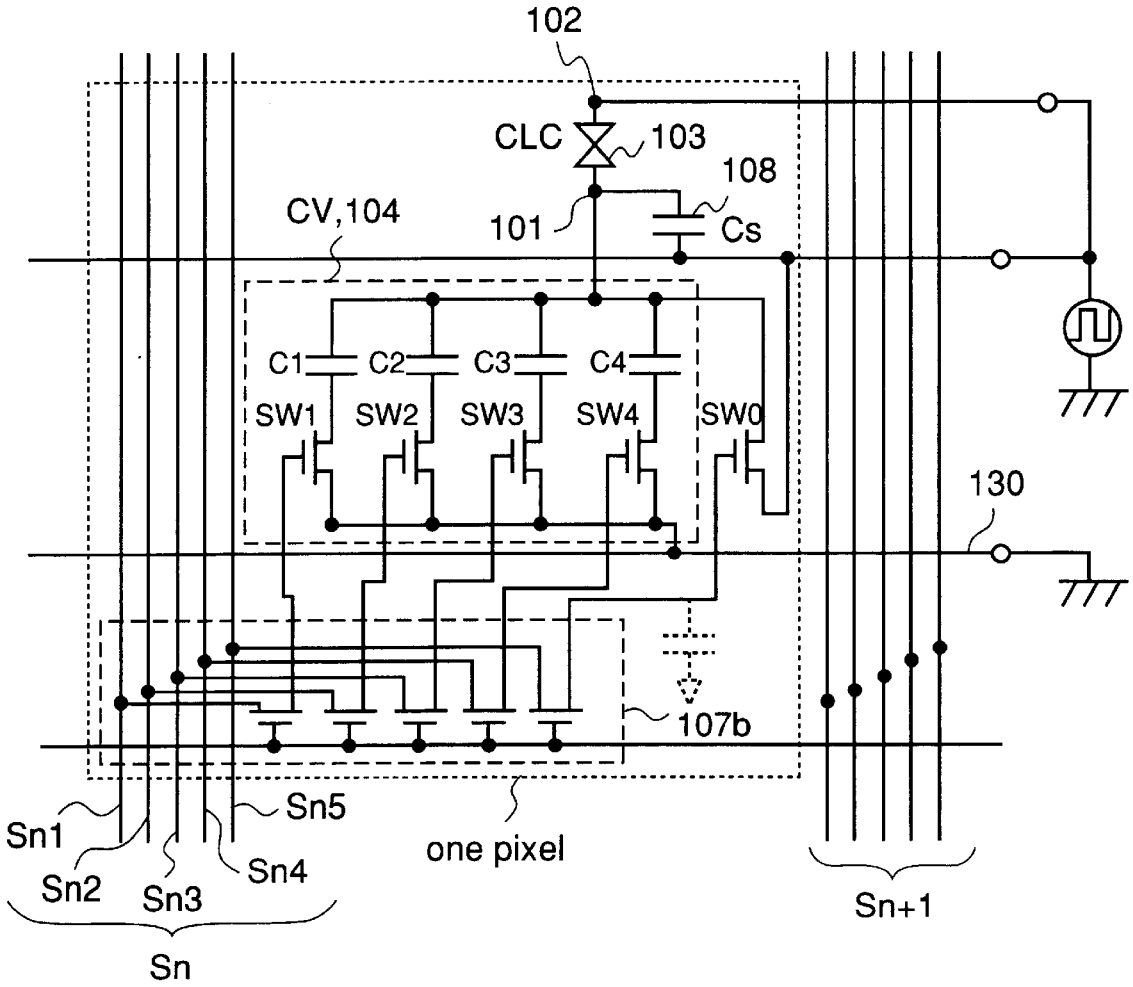
FIG. 23 schematically shows the configuration of a liquid crystal display device according to a seventh embodiment of the invention.

FIG. 23 schematically shows the configuration of a liquid crystal display device according to a seventh embodiment of the invention.

In this liquid crystal display device, switches SW1–SW4 of a variable capacitance element (Cv) 104 are thin-film transistors. The common line for the sources/drains of the thin-film transistors located opposite to capacitors C1–C4 is connected to a ground line 130. An AC voltage is applied to a liquid crystal layer 103 from the opposed electrode 102 side.

With this configuration, voltages to turn off the switches SW1–SW4 can be negative with respect to the potential of the ground line 130 (when the thin-film transistors are of an n-channel type). Further, the switches SW1–SW4 can be turned on by applying, to the switches SW1–SW4, voltages that are equal to the threshold voltage Vth of the thin-film transistors plus $\alpha$ when measured with respect to the potential of the ground line 130.

As a result, gate voltages for on/off-controlling the thin-film transistors as the switches SW1–SW4 can be reduced and hence signal voltages of a matrix circuit 107*b* can also be made low.

Although in the above example the one ends of the thin-film transistors as the switches SW1–SW4 are commonly connected to the ground line 130, they may be commonly connected to a line having a certain voltage. In this case, the gate driving voltages of the thin-film transistors may be increased by the voltage of the line.

In the example of FIG. 23, the control circuit 107 is the matrix circuit 107*b* rather than the above-described decoder 107*a*.

Figure 24:
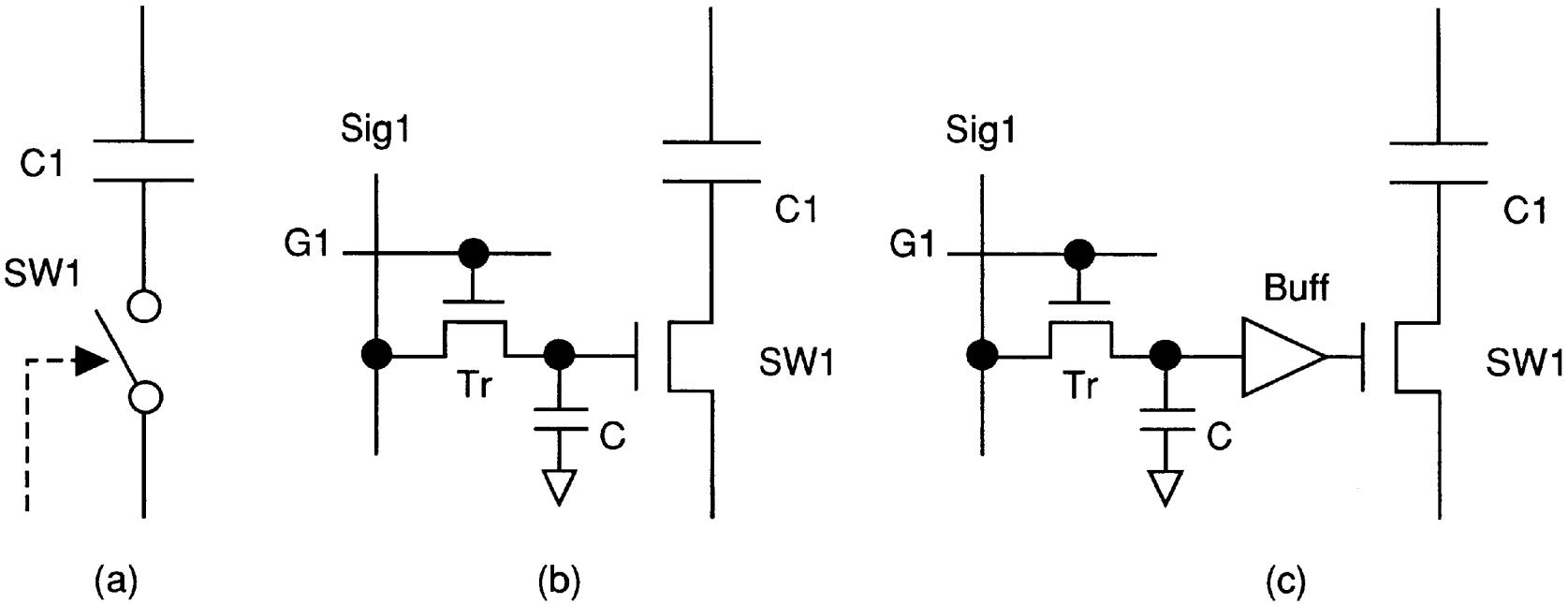
FIGS. 24(*a*)–24(*c*) show circuits for controlling each switch in the liquid crystal display device according to the seventh embodiment.

FIGS. 24(*a*)–24(*c*) show circuits for controlling each of the switches SW1–SW4 in the liquid crystal display device according to this embodiment. FIG. 24(*a*) schematically shows each capacitor-switch set of the variable capacitance element 104. A voltage from a signal line may be applied to the gate of the thin-film transistor as each switch of the variable capacitance element 104 directly as shown in FIG. 24(*b*) or via a buffer as shown in FIG. 24(*c*). The circuit of FIG. 24(*c*) can decrease the signal line voltage and hence reduce the power consumption of the signal line driving.

As shown in FIG. 23, the thin-film transistors as the switches SW1–SW4 and SW0 are driven by signal lines Sn1–Sn5, respectively. In this manner, the thin-film transistors of the variable capacitance element 104 can be controlled without using the decoder 107*a*. This configuration is particularly effective in a case where increasing the number of signal lines is more advantageous than increasing the integration density of the decoder 107*a*.

Embodiment 8

Figure 25:
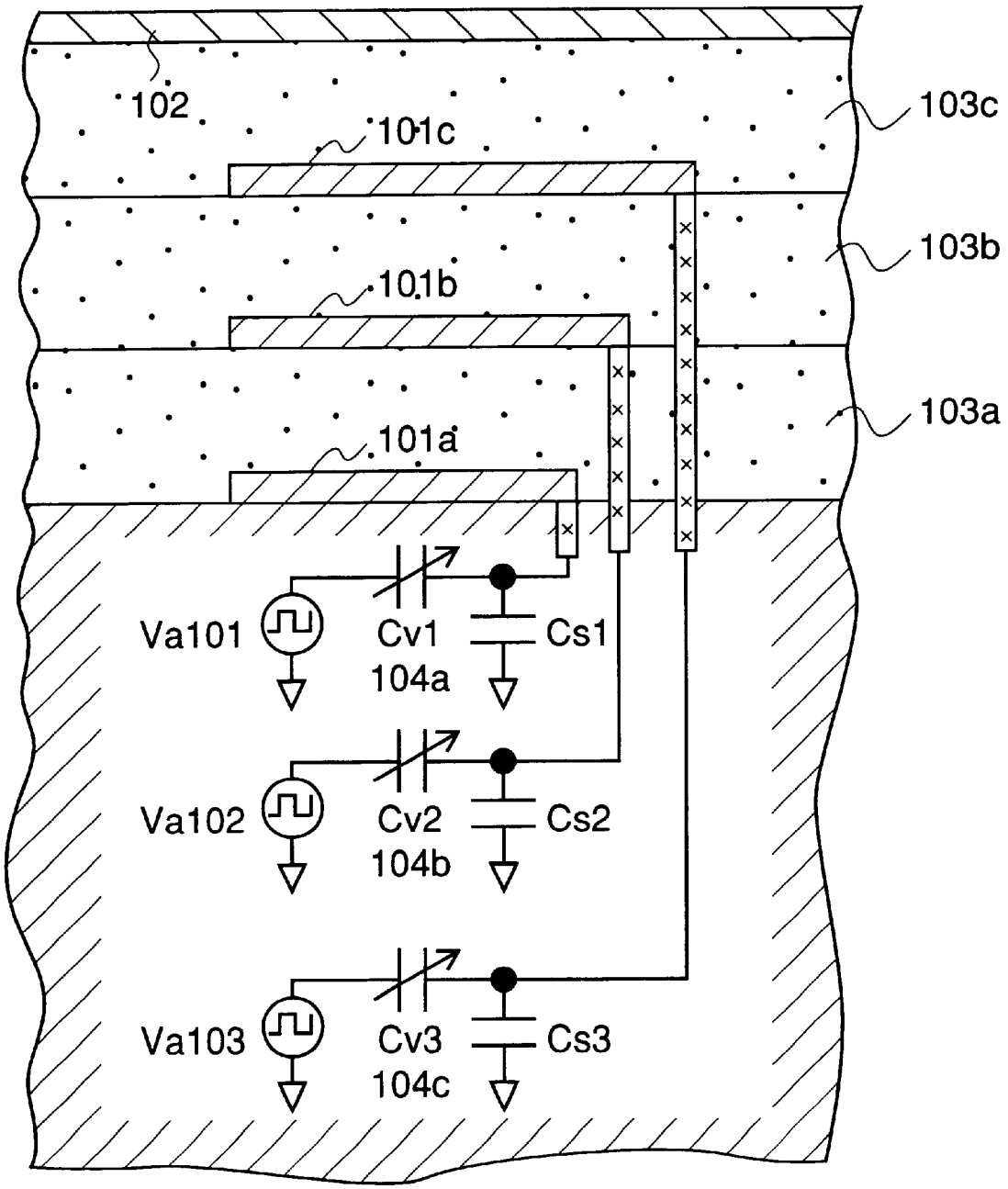
FIG. 25 shows the configuration of a liquid crystal display device according to an eighth embodiment of the invention.

FIG. 25 shows the configuration of a liquid crystal display device according to an eighth embodiment of the invention, in which the invention is applied to a case where a unit pixel is constructed by laying a plurality of liquid crystal layers, specifically, three GH liquid crystal layers, one on another.

The unit pixel is composed of three liquid crystal layers 103*a*–103*c*, pixel electrodes 101*a*–101*c* for applying voltages corresponding to display signals to the respective liquid crystal layers 103*a*–103*c*, and an opposed electrode 102. The pixel electrode 101*a* is made of a metal having high reflectance such as aluminum so as to also serve as a reflection plate. The surface of the pixel electrode 101*a* is formed with a number of minute asperities to improve the reflection characteristic. A driver circuit for applying display signal voltages to the pixel electrodes 101*a*–101*c* is provided on the array substrate side and the array substrate is connected to the pixel electrodes 101*b* and 101*c* via interlayer conductors such as plated poles.

In this example, guest-host liquid crystals sealed in microcapsules are used in the liquid crystal layers 103*a*–103*c*. Alternatively, liquid crystals may be injected by providing partitions made of film, glass, or the like between the liquid crystal layers 103*a*–103*c*. The liquid crystal layers 103*a*–103*c* are of three subtractive primary colors of cyan, magenta, and yellow.

Variable capacitance elements 104*a*–104*c* are connected to the respective pixel electrodes 101*a*–101*c*. Auxiliary capacitors Cs1–Cs3 are connected to the respective pixel electrodes 101*a*–101*c* so as to be parallel with the respective variable capacitance elements 104*a*–104*c*.

AC voltages are applied from AC voltage supply systems Va101–Va103 to the variable capacitance elements 104*a*–104*c*, respectively. Application voltages to the respective pixel electrodes 101*a*–101*c* are determined by the capacitive voltage division involving the liquid crystal layers 103*a*–103*c* and the variable capacitance elements 104*a*–104*c*.

Although for the sake of simplicity switches between the AC voltage supply systems and the pixel circuit and a control circuit for switches that determine the capacitance values of the variable capacitance elements 104*a*–104*c* are omitted in FIG. 25, they may be configured in the same manners as in the above embodiments.

With the above configuration, prescribed AC voltages can be applied to the plurality of liquid crystal layers 103*a*–103*c* by equalizing the frequencies of the AC voltages and keeping phase differences between the AC voltages. It is preferable to set the phase differences at 0° or 180°. It is also preferable to employ rectangular AC voltages.

The above configuration succeeded in obtaining bright, superior color display. Further, the liquid crystal display device of this embodiment realized display of high image quality, because display data are written to the pixel circuit and hence AC voltages having prescribed amplitudes can be applied continuously to the liquid crystal layers 130*a*–103*c* until the next writing. The number of laminated liquid crystal layers is not limited to three and the invention is similarly applicable as long as the number of laminated liquid crystal layers is two or more. For example, a four-layer structure may be employed that includes a black layer in addition to the cyan, magenta, and yellow layers.

Embodiment 9

Figure 26:
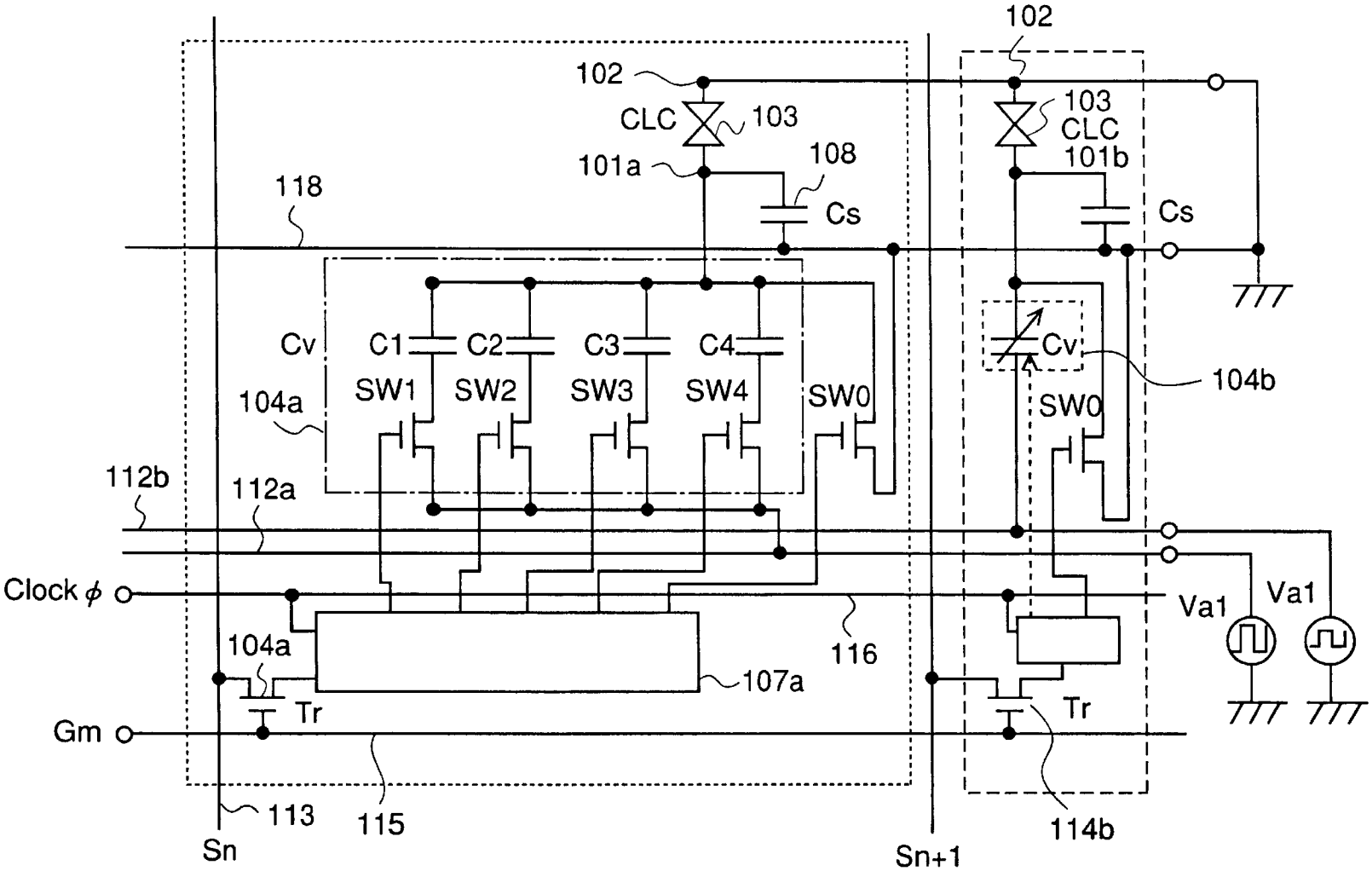
FIG. 26 shows the configuration of a liquid crystal display device according to a ninth embodiment of the invention.

FIG. 26 shows the configuration of a liquid crystal display device according to a ninth embodiment of the invention, specifically, the configurations of two pixels 110*a* and 110*b* that are adjacent to each other in the scanning line direction (the configuration of the pixel 110*b* is simplified). This embodiment is directed to a case where a single AC voltage is provided for each unit pixel (see FIG. 22).

In the liquid crystal display device according to this embodiment shown in FIG. 26, AC voltages Va1 and Va1' are applied to respective pixel electrodes 101*a* and 101*b* that are adjacent to each other in the scanning line direction. The AC voltages Va1 and Va1' have the same frequency and amplitude and are opposite in phase.

A variable capacitance element 104*a* for the pixel electrode 101*a* is connected to a first AC voltage supply system for supplying the AC voltage Va1, and a variable capacitance element 104*b* for the pixel electrode 101*b* is connected to a second AC voltage supply system for supplying the AC voltage Va1'.

With the above configuration, AC voltages supplied to adjacent pixel electrodes have different phases and hence AC voltages opposite in phase are applied to the regions of an opposed electrode 102 corresponding to adjacent pixel electrodes. Therefore, even if the impedance of the opposed electrode 102 is somewhat high as in a case where the opposed electrode 102 is made of ITO, for example, the potential of the opposed electrode 102 is less prone to vary, whereby what is called crosstalk can be reduced. AC voltages opposite in phase are also applied to signal lines or the like that are coupled with lines 112*a* and 112*b* for supplying the respective AC voltages Va1 and Va1', which contributes to noise reduction.

The manner of providing the AC voltage supply systems is not limited to providing a plurality of independent power supplies. For example, a configuration is possible in which a single AC power supply is used and a plurality of AC voltages are produced through resistive or capacitive voltage division.

As described above, the phases of AC voltages may be shifted from each other. In the pixel circuit of an actual liquid crystal display device, forming the pixel electrode so as to cover the pixel circuit with an insulating film interposed in between is desirable for the purpose of increasing the aperture ratio. Noise generation at the pixel electrode can be inhibited by providing a shield layer between the pixel electrode and the pixel circuit. The capacitors can be formed by utilizing the gate insulating film or the interlayer insulating film of the thin-film transistors. Alternatively, the capacitors may be formed by using a dedicated insulating material.

Examples of the liquid crystal material of the liquid crystal layer are a guest-host liquid crystal, a TN liquid crystal, an (anti)ferroelectric liquid crystal, a cholesteric liquid crystal, and a polymer dispersion type liquid crystal.

The above embodiments may be combined when necessary, and other various modifications are possible without departing from the spirit and scope of the invention.

What is claimed is:

1. A liquid crystal display device comprising:

a liquid crystal layer held between a first electrode and a second electrode;

means for applying an AC voltage to the first electrode or the second electrode;

means for supplying a display signal;

means for selecting the display signal;

means for holding the selected display signal; and an impedance element connected in series to the first electrode, an impedance of the impedance element being varied in accordance with the display signal being held, wherein the impedance element comprises a parallel connection of a plurality of series connections of a switching element and a capacitor, and wherein a gradation level of the liquid crystal layer is varied by making a control of selecting, in accordance with the display signal, part of the switching elements to be turned on.

2. A liquid crystal display device according to claim 1, wherein the switching elements are a plurality of field-effect transistors having different threshold values and the display signal is supplied to gate electrodes of the respective field-effect transistors from a commonly connected terminal, and wherein the impedance of the impedance element is varied by increasing or decreasing the number of field-effect transistors to be turned on in order of magnitude of the threshold voltages.

3. A liquid crystal display device comprising:

a first substrate on which pixel electrodes are arranged in matrix form;

a second substrate on which a common electrode is provided;

a liquid crystal layer held between the pixel electrodes and the common electrode;

means for applying an AC voltage to each of the pixel electrodes;

means for supplying a display signal;

means for selecting and holding the display signal; and an impedance element connected in series to each of the pixel electrodes, an impedance of the impedance element being varied in accordance with the display signal being held, wherein the impedance element comprises a parallel connection of a plurality of series connections of a variable resistance element and a capacitor, and wherein impedance values of the variable resistance elements are controlled in accordance with the display signal.

4. A liquid crystal display device according to claim 3, wherein a liquid crystal application voltage is varied gently in accordance with the display signal by making the impedance values of the variable resistance elements different from each other in accordance with the display signal, whereby analog-like halftone display is performed.

5. A liquid crystal display device comprising:

a first substrate on which pixel electrodes are arranged in matrix form;

a second substrate on which a common electrode is provided;

a liquid crystal layer held between the pixel electrodes and the common electrode;

means for applying an AC voltage to each of the pixel electrodes;

means for supplying a display signal;

means for selecting and holding the display signal; and an impedance element connected in series to each of the pixel electrodes, an impedance of the impedance element being varied in accordance with the display signal being held, wherein the impedance element comprises a parallel connection of a plurality of series connections of a switching element and a capacitor, and wherein a gradation level of the liquid crystal layer is varied by controlling, in accordance with the display signal, the number of switching elements to be turned on.

6. A liquid crystal display device according to claim 5, wherein capacitance values of the capacitors are so set that gradation voltages are varied smoothly by combinations of the capacitance values.

7. A liquid crystal display device according to claim 5, wherein the switching element is a thin-film transistor whose resistance values is set at an intermediate resistance value in an operation range.

8. A liquid crystal display device according to claim 5, wherein the switching elements are a plurality of field-effect transistors having different threshold values and the display signal is supplied to gate electrodes of the respective field-effect transistors from a commonly connected terminal, and wherein the impedance of the impedance element is varied by increasing or decreasing the number of field-effect transistors to be turned on in order of magnitude of the threshold voltages.

9. A liquid crystal display device according to claim 5, wherein a total load capacitance including a capacitance of the impedance element as viewed from the switching elements is set smaller than a liquid crystal capacitance.

10. A liquid crystal display device comprising:

a liquid crystal layer held between a first electrode and a second electrode;

means for supplying a display signal;

means for selecting the display signal;

a variable capacitance element connected in series to the first electrode, a capacitance of the variable capacitance element being varied during operation of the liquid crystal display device in accordance with the selected display signal;

first applying means for applying a first AC voltage;

second applying means for applying a second AC voltage that is different in amplitude from the first AC voltage; and switching means for applying the first AC voltage or the second AC voltage to the first electrode or the second electrode via the variable capacitance element in accordance with the selected display signal.

11. A liquid crystal display device according to claim 10, wherein the variable capacitance element comprises a parallel connection of a plurality of series connections of a switching element and a capacitor, and wherein the capacitance of the variable capacitance element is varied by turning on or off the switching elements in accordance with the selected displays signal.

12. A liquid crystal display device according to claim 11, wherein the switching means is a decoder that on/off-controls the switching elements in accordance with the display signal.

13. A liquid crystal display device according to claim 10, wherein the switching means switches between the first and second AC voltages so that a first gradation range of the liquid crystal layer that is displayed through application of the first AC voltage is made continuous with a second gradation range of the liquid crystal layer that is displayed through application of the second AC voltage.

14. A liquid crystal display device comprising:

a first liquid crystal layer held between a first electrode and a second electrode;

a second liquid crystal layer held between the second electrode and a third electrode and laid on the first liquid crystal layer;

a third liquid crystal layer held between the third electrode and an opposed electrode and laid on the second liquid crystal layer;

first applying means for applying a first AC voltage;

second applying means for applying a second AC voltage;

third applying means for applying a third AC voltage;

a first variable capacitance element interposed between the first applying means and the first electrode, a capacitance of the first variable capacitance element being varied during operation of the liquid crystal display device in accordance with a first display signal;

a second variable capacitance element interposed between the second applying means and the second electrode, a capacitance of the second variable capacitance element being varied during operation of the liquid crystal display device in accordance with a second display signal; and a third variable capacitance element interposed between the third applying means and the third electrode, a capacitance of the third variable capacitance element being varied during operation of the liquid crystal display device in accordance with a third display signal, wherein voltages produced by dividing the first, second, and third AC voltages by the first, second and third variable capacitance elements and the first, second, and third liquid crystal layers are applied to the first, second and third electrodes, respectively.

15. A liquid crystal display device according to claim 14, wherein the first, second, and third AC voltages have the same frequency and phases of AC voltages that are applied to a plurality of pixel electrodes that constitute a unit pixel are equalized for the unit pixel.

16. A liquid crystal display device according to claim 14, wherein each of the first, second, and third variable capacitance elements comprises a parallel connection of a plurality of series connections of a switching element and a capacitor, and wherein the capacitances of the first, second, and third variable capacitance elements are varied by turning on or off the switching elements in accordance with the first, second, and third display signals, respectively.

17. A liquid crystal display device according to claim 14, wherein the first and second liquid crystal layers are made of guest-host liquid crystals containing dyes of different colors and laid one on another to constitute a unit pixel.

* * * * *